US007589023B2

(12) United States Patent
Taniguchi et al.

(10) Patent No.: US 7,589,023 B2
(45) Date of Patent: Sep. 15, 2009

(54) METHOD OF MANUFACTURING SEMICONDUCTOR WAFER

(75) Inventors: Toru Taniguchi, Tokyo (JP); Etsuro Morita, Tokyo (JP); Satoshi Matagawa, Tokyo (JP); Seiji Harada, Tokyo (JP); Isoroku Ono, Tokyo (JP); Mitsuhiro Endo, Tokyo (JP); Fumihiko Yoshida, Tokyo (JP)

(73) Assignee: Sumitomo Mitsubishi Silicon Corporation, Tokyo (JP)

( * ) Notice: Subject to any disclaimer, the term of this patent is extended or adjusted under 35 U.S.C. 154(b) by 1220 days.

(21) Appl. No.: 10/258,282

(22) PCT Filed: Apr. 23, 2001

(86) PCT No.: PCT/JP01/03509

§ 371 (c)(1),
(2), (4) Date: Oct. 23, 2002

(87) PCT Pub. No.: WO01/82354

PCT Pub. Date: Nov. 1, 2001

(65) Prior Publication Data

US 2003/0104698 A1 Jun. 5, 2003

(30) Foreign Application Priority Data

Apr. 24, 2000 (JP) ..... 2000-122272
Jun. 30, 2000 (JP) ..... 2000-199561
Aug. 25, 2000 (JP) ..... 2000-255018

(51) Int. Cl.
*H01L 21/302* (2006.01)

(52) U.S. Cl. ..... 438/692; 438/691; 451/285

(58) Field of Classification Search ..... 438/692, 438/698, 691, 693; 451/285, 287
See application file for complete search history.

(56) References Cited

U.S. PATENT DOCUMENTS 5,110,428 A * 5/1992 Prigge et al. ..... 428/64.1
5,514,245 A * 5/1996 Doan et al. ..... 438/693
5,643,405 A 7/1997 Bello et al. ..... 156/636.1

(Continued)

FOREIGN PATENT DOCUMENTS

DE 197 04 546 A1 8/1998

(Continued)

OTHER PUBLICATIONS

Tsutomu, Both Surfaces Polishing Method of Semiconductor Wafer, Aug. 27, 1999, English translation by computer for JP 11233462 A, 7 pages.*

(Continued)

*Primary Examiner*—Lan Vinh
(74) *Attorney, Agent, or Firm*—Kubovcik & Kubovcik

(57) ABSTRACT

A method of manufacturing a semiconductor wafer, comprising the step of differentiating the glossiness of a front surface from that of a rear surface of the wafer by using an abrasive cloth with a semiconductor wafer sink rate different in polishing from that of the other abrasive cloth for one of a polishing cloth (14) on an upper surface plate (12) and a polishing cloth (15) on a lower surface plate (13) so as to simultaneously polish both the front and rear surfaces of the semiconductor wafer (W), or differentiating by differentiating the rotating speed of the upper surface plate from that of the lower surface plate.

9 Claims, 11 Drawing Sheets

U.S. PATENT DOCUMENTS

| | | | | | |
|---|---|---|---|---|---|
| 5,827,779 | A | * | 10/1998 | Masumura et al. | 438/692 |
| 5,897,426 | A | * | 4/1999 | Somekh | 451/41 |
| 6,004,866 | A | * | 12/1999 | Nakano et al. | 438/459 |
| 6,043,156 | A | * | 3/2000 | Kai et al. | 438/692 |
| 6,051,498 | A | | 4/2000 | Pietsch et al. | 438/691 |
| 6,080,048 | A | * | 6/2000 | Kotagiri et al. | 451/285 |
| 6,089,966 | A | * | 7/2000 | Arai et al. | 451/533 |
| 6,328,644 | B1 | * | 12/2001 | Kuramochi et al. | 451/526 |
| 6,352,927 | B2 | * | 3/2002 | Kishimoto | 438/690 |
| 6,432,823 | B1 | * | 8/2002 | Huynh et al. | 438/690 |
| 2001/0039101 | A1 | * | 11/2001 | Wenski | 438/471 |
| 2002/0052064 | A1 | * | 5/2002 | Grabbe et al. | 438/113 |

FOREIGN PATENT DOCUMENTS

| | | | | |
|---|---|---|---|---|
| EP | 1 005 069 | A2 | | 5/2000 |
| JP | 54-122087 | A | | 9/1979 |
| JP | 56-12734 | A | | 2/1981 |
| JP | 60-197367 | A | | 10/1985 |
| JP | 01-127266 | A | | 5/1989 |
| JP | 2-9571 | | | 1/1990 |
| JP | 3-188630 | A | | 8/1991 |
| JP | 03-188630 | A | | 8/1991 |
| JP | 04-129655 | A | | 4/1992 |
| JP | 06-275525 | A | | 9/1994 |
| JP | 07-045564 | A | | 2/1995 |
| JP | 09-011112 | A | | 4/1997 |
| JP | 10-135164 | A | | 5/1998 |
| JP | 10-202511 | A | | 8/1998 |
| JP | 11233462 | A | * | 8/1999 |
| JP | 11-254302 | A | | 9/1999 |
| JP | 2000-42912 | A | | 2/2000 |
| JP | 2000-042912 | A | | 2/2000 |
| JP | 2000-91282 | A | | 3/2000 |
| JP | 2000-216119 | A | | 8/2000 |

OTHER PUBLICATIONS

Zhang et al., Method for Processing a Semiconductor Wafer Using Double-Side Polishing, WO 02/11947 A2, Jul. 5, 2001.*

* cited by examiner

METHOD OF MANUFACTURING SEMICONDUCTOR WAFER

FIELD OF THE INVENTION

The present invention relates to a method of manufacturing a semiconductor wafer, and in more specific, to a method of manufacturing a semiconductor wafer in which the semiconductor wafer is polished by using a double-sided polisher having no sun gear incorporated thereinto, thereby obtaining such a semiconductor wafer with a front and a back surfaces having a different glossiness from each other.

DESCRIPTION OF THE PRIOR ART

In manufacturing wafers having both surfaces polished according to the prior art, such a process has been employed as described below. In specific, a single crystal silicon ingot is sliced to be formed into silicon wafers, and then those silicon wafers are subjected to a series of processing steps of beveling, lapping and acid etching in sequence. These steps are followed by a double-sided polishing process for mirror-finishing both front and back surfaces of the wafers.

This double-sided polishing typically uses a double-sided polisher having an epicyclic gear system, in which a sun gear is disposed in the central region while an internal gear is disposed in the outer periphery thereof. In this double-sided polisher, the silicon wafers are inserted and thus held in a plurality of wafer holding holes formed in a carrier plate, respectively. Then the carrier plate is driven to make a rotation on its own axis and also a revolution between the sun gear and the internal gear in a state in which an upper surface plate and a lower surface plate, each having polishing-cloth extending over the opposite surface thereof respectively, are pressed against the front and the back surfaces of respective wafers, while supplying slurry containing abrasive grains to the silicon wafers from above, so that the front and the back surfaces of respective wafers are polished all at once.

As discussed above, this double-sided polisher of the epicyclic gear type includes the sun gear located in the central portion of the unit. To fabricate a set of equipment for applying the double-sided polishing to those wafers of large gauge, such as 300 mm wafers, disadvantageously the carrier plate and thus the entire unit could be enlarged by a size to accommodate the sun gear. There has been a problem in this concern that, for example, it may lead to the fabricated equipment for the double-sided polishing that has a diameter not smaller than 3 m.

In the circumstances as described above, there has been known one double-sided polisher to solve the problem according to the prior art, as disclosed in the Japanese Patent Publication No. H11-254302.

This double-sided polisher comprises a carrier plate having a plurality of wafer holding holes for holding silicon wafers, an upper surface plate and a lower surface plate disposed above and beneath the carrier plate respectively, with polishing cloths extending over the opposite surfaces of the upper and the lower surface plates for polishing the front and the back surfaces of the silicon wafers held in the wafer holding holes so as to have the same level of glossiness, and a carrier drive means for driving the carrier plate held between the upper surface plate and the lower surface plate to make a motion within a plane parallel with the surface of the carrier plate.

The motion of the carrier plate in the context herein means such a circular motion of the carrier plate in which the carrier plate does not rotate on its own axis but the silicon wafers are allowed to rotate in respective wafer holding holes.

It is to be appreciated that during double-sided polishing of the silicon wafers, the upper and the lower surface plates are rotated in opposite directions from each other around respective vertical rotation axes as their center of rotation.

Accordingly, during double-sided polishing of the silicon wafers, the silicon wafers are held in respective holding holes and the carrier plate is driven to make a circular motion associated with no rotation on its own axis while supplying a slurry containing abrasive grains to the silicon wafers as well as rotating the upper and the lower surface plates. As a result, respective silicon wafers can be simultaneously polished in both surfaces thereof.

Besides, this double-sided polisher has no sun gear incorporated therein, which allows a space on the carrier plate available for forming respective holding holes to be expanded by an area which otherwise would be occupied for accommodating the sun gear. As a result, in comparison with the other double-sided polisher with sun gear, this double-sided polisher (hereafter, referred to as a double-sided polisher with no sun gear) having the same size thereto can handle the silicon wafers of larger size.

However, there have been following problems in association with the method for double-sided polishing of the silicon wafers by using the double-sided polisher with no sun gear according to the prior art.

In specific, according to this double-sided polishing method, both of the front and the back surfaces of the silicon wafer have been finished to have the same glossiness. This is because the polishing cloths of same type and same material have been used to form the polishing cloths extended over the upper and the lower surface plates respectively. In this regard, commonly used polishing cloth can be classified into three types. A first one is an expanded urethane type composed of expanded urethane sheet, a second one is a non-woven fabric type composed of non-woven fabric, such as polyester, which is impregnated with urethane resin, and a third one is a suede type.

As discussed above, the double-sided polishing method according to the prior art, in which the silicon wafer has been finished to have the same glossiness in both of the front and the back surfaces thereof, could not handle such a case where, for example, only the back surface of the wafer is desired to have a lower glossiness thus to form a satin-finished surface or a case where only the front surface of the wafer is desired to be mirror-polished in order to form only the back surface of the wafer into a gettering surface.

SUMMARY OF THE INVENTION

An object of the present invention is to provide a method of manufacturing a semiconductor wafer, in which such a semiconductor wafer having a front and a back surfaces different in glossiness thereof from each other can be selectively manufactured yet with a lower cost.

Another object of the present invention is to provide a method of manufacturing a semiconductor wafer, in which such a wafer can be manufactured whose back surface can be detected by using an optical sensor and whose front and back surfaces can be identified with respect to each other.

Yet another object of the present invention is to provide a method of manufacturing a semiconductor wafer, in which such a wafer having high level of flatness can be manufactured with a smaller polishing volume in a shorter polishing time, and a back surface of the wafer is not apt to be mirror-polished during the double-sided polishing of the wafer.

The present invention as defined in claim 1 provides a method of manufacturing a semiconductor wafer, in which a semiconductor wafer is held in a wafer holding hole formed in a carrier plate, and the carrier plate is driven to make a motion within a plane parallel with a surface of the carrier plate between an upper surface plate and a lower surface plate having polishing cloths extended thereon respectively, while supplying a slurry containing abrasive grains to the semiconductor wafer, so that a front and a back surfaces of the semiconductor wafer can be polished simultaneously, said method further characterized in that one polishing cloth different from the other polishing cloth in a sink rate of the semiconductor wafer during polishing is used for one of the upper and the lower surface plates while using the other polishing cloth for the other of the surface plates so as to differentiate the glossiness between the front surface and the back surface of the semiconductor wafer.

The double-sided polisher to be used is not limited to a specific one but may be any double-sided polisher with no sun gear in so far as it includes no sun gear incorporated therein and allows the carrier plate to make a motion between the upper surface plate and the lower surface plate so that the front and the back surfaces of the semiconductor wafer may be polished simultaneously.

The semiconductor wafer in this context refers to a silicon wafer, a gallium arsenide wafer and so on. The semiconductor wafer is not limited in size. It may be a wafer having a large diameter, including, for example, a 300 mm wafer. The semiconductor wafer may be coated with an oxide film on either one of the surfaces. In that case, a bare wafer surface in the opposite side to the oxide film of the semiconductor wafer may be selectively polished.

The number of the wafer holding holes formed in the carrier plate may be only one or may be more. The size of the wafer holding hole may be modified arbitrarily depending on the size of the semiconductor wafer to be polished.

The motion of the carrier plate may be any motion in so far as it is within the plane parallel with the front (or the back) surface of the carrier plate, and other conditions, such as the direction of the motion, may not be limited. For example, it may be such a circular motion of the carrier plate associated with no rotation on its own axis, in which the silicon wafer held between the upper surface plate and the lower surface plate may be caused to rotate within its corresponding wafer holding hole. In addition, the motion of the carrier plate may also include a circular motion around its centerline, a circular motion at an eccentric position, or a linear motion. In case of the linear motion, it is preferable that the upper and the lower surface plates are rotated around respective axis lines in order to achieve uniform polishing of the front and the back surfaces of the wafer.

The type of the slurry is not limited. For example, an alkaline etchant of pH 9-11 containing an mount of diffused particles of colloidal silica (abrasive grains) with an averaged grain size in a range of 0.02-0.1 μm may be used. Alternatively, the slurry may be an acid etchant containing an amount of diffused abrasive grains. The quantity of the slurry to be supplied is not limited but may be varied depending on the size of the carrier plate. In one example, the slurry is supplied at a rate of 1.0-2.0 litter/min. The supply of the slurry to the semiconductor wafer may be directed to the central region of the carrier plate.

The speed of rotation of the upper surface plate and that of the lower surface plate are not limited. For example, they may be rotated at the same speed or at different speeds. Further, the direction of the rotation is not limited. In specific, they may be rotated in the same direction or rotated inversely to each other. In this regard, the upper and the lower surface plates are not necessarily rotated together at the same time. This is because the present invention has employed a configuration in which the carrier plate is driven to make a motion in a state where respective polishing cloths of the upper and the lower surface plates are pressed against the front and the back surfaces of the semiconductor wafer.

The pressure of the upper or the lower surface plate to be applied against the semiconductor wafer is not limited. For example, the pressure of 150-250 g/cm$^2$ may be used.

Further, a quantity to be polished off from the front and the back surfaces of the wafer and a polishing rate to be applied thereto are also not limited. A difference in the polishing rate between the front surface and the back surface of the wafer may have a great influence on the glossiness of the front and the back surfaces of the wafer.

The type and material of respective polishing cloths to be extended over the upper and the lower surface plates are not limited. For example, a hard pad of expanded urethane foam or a pad of non-woven fabric impregnated with urethane resin and then set therewith may be used. In addition, such a pad composed of base fabric made of non-woven fabric and urethane resin expanded on the base fabric may be used.

In the present invention, two types of polishing cloths having different sink rate of the semiconductor wafer during polishing from each other have been employed as the polishing cloths for the upper surface plate and the lower surface plate respectively. It is to be appreciated that the sink rate is not limited.

The method for differentiating the sink rate of the semiconductor wafer is not limited. For example, the method may employ such polishing cloths having different hardness from each other, polishing cloths having different densities from each other, polishing cloths having different compressibility from each other, or polishing cloths having different elastic modulus in compression from each other. If such a pair of polishing cloths having different hardness, densities, compressibility, or elastic modulus in compression from each other is used to polish the front and the back surfaces of the semiconductor wafer simultaneously, then the semiconductor wafer can be polished to have different glossiness between the front surface and the back surface thereof.

The terms, "the glossiness is different" for the purpose of the present invention refers to that either one of the surfaces (typically, the front surface of the wafer) has a higher glossiness as compared to the other surface (typically, the back surface of the wafer). Known measuring instrument (e.g., a gloss meter available from Nippon Denshoku Inc.) may be used to measure the glossiness.

Further, as to the method used to differentiate the sink rate of the semiconductor wafer, in one example, the hardness, density, compressibility or elastic modulus in compression may be differentiated from each other between the polishing cloths made of same material.

A difference in glossiness created between the front surface and the back surface of the wafer is not limited. For example, the polished wafer may have a mirror-finished front surface and a satin-finished back surface. Alternatively, the front surface of the wafer may be formed into a mirror-finished surface while the back surface of the wafer may not be polished at all.

Further, the present invention as defined in the first embodiment provides a method of manufacturing a semiconductor wafer in accordance with claim 1, in which the motion of the carrier plate is a circular motion associated with no rotation on its own axis.

The circular motion of the carrier plate associated with no rotation on its own axis in this context refers to such a circular motion that the carrier plate is revolved while keeping always an eccentric condition by a predetermined distance with respect to an axis line of the upper and the lower surface plates. Because of the circular motion of the carrier plate associated with no rotation on its own axis, all the points on the carrier plate can be controlled to trace the same sized small circular orbit.

Further, the present invention as defined in claim 3 provides a method of manufacturing a semiconductor wafer in accordance with claim 1, in which a hardness of the polishing cloth of the upper surface plate is different from that of the polishing cloth of the lower surface plate.

The hardness is not limited in those polishing cloths. In one example, the polishing cloth having the hardness in a range of 50 to 100° (as measured by the Asker hardness meter) may be used.

The ratio of hardness of one polishing cloth to the other polishing cloth is also not limited. For example, the ratio of 1:1.05-1.60 may be used.

Still further, the present invention as defined in claim 4 provides a method of manufacturing a semiconductor wafer in accordance with claim 1, in which a density of the polishing cloth of the upper surface plate is different from that of the polishing cloth of the lower surface plate.

Respective densities of those polishing cloths are not limited. For example, the polishing cloth having the density in a range of 0.30-0.80 g/cm$^3$ may be used.

The ratio of density of one polishing cloth to the other polishing cloth is also not limited. For example, the ratio of 1:1.1-2.0 may be used.

Besides, the present invention as defined in claim 5 provides a method of manufacturing a semiconductor wafer in accordance with claim 1, in which a compressibility of the polishing cloth of the upper surface plate is different from that of the polishing cloth of the lower surface plate.

The compressibility of each polishing cloth is not limited. For example, the polishing cloth having the compressibility in a range of 1.0-8.0% may be used.

The ratio of compressibility of one polishing cloth to the other is also not limited. For example, the ratio of 1:1.2-8.0 may be used.

Further, the present invention as defined in claim 6 provides a method of manufacturing a semiconductor wafer in accordance with claim 1, in which an elastic modulus in compression of the polishing cloth of the upper surface plate is different from that of the polishing cloth of the lower surface plate.

The elastic modulus in compression of each polishing cloth is not limited. For example, the polishing cloth having the elastic modulus in compression in a range of 60-90% may be used.

The ratio of the elastic modulus in compression of one polishing cloth to the other is also not limited. For example, the ratio of 1:1.1-1.5 may be used.

Further, the present invention as defined in claim 7 provides a method of manufacturing a semiconductor wafer in accordance with any one of claims 3 through 6, in which either one of the polishing cloth of the upper surface plate and the polishing cloth of the lower surface plate is made of expanded urethane foam pad and the other of the polishing cloths is made of non-woven fabric pad.

The hardness, density, compressibility and elastic modulus in compression of the expanded urethane foam pad and the non-woven fabric pad are not limited. The preferable values for the expanded urethane foam pad may be the hardness (as measured by the Asker hardness meter) in the range of 80-95°, the density in the range of 0.4-0.8 g/cm$^3$, the compressibility in the range of 1.0-3.5% and the elastic modulus in compression in the range of 50-70%. In contrast to this, those for the non-woven fabric pad may be the hardness in the range of 60-82°, the density in the range of 0.2-0.6 g/cm$^3$, the compressibility in the range of 2.5-8.5% and the elastic modulus in compression in the range of 70-88%.

Still further, the present invention as defined in claim 8 provides a method of manufacturing a semiconductor wafer in accordance with any one of claims 1 through 7, in which the slurry is supplied from a slurry supply hole located right above the wafer holding hole.

Preferably, the slurry should be supplied directly to the area in which the silicon wafer resides. It is to be noted that the method for supplying the slurry is not limited. For example, if the surface to which the slurry is to be supplied is the upper surface of the semiconductor wafer, then the slurry may be supplied by way of gravity-drop through a slurry supply nozzle. In this case, a through-hole may be formed in the carrier plate so that the slurry drops to the lower surface plate side therethrough.

Further, the present invention as defined in claim 9 provides a method of manufacturing a semiconductor wafer in accordance with any one of claims 1 through 8, in which either one of the front surface and the back surface of the semiconductor wafer is polished lightly to form a light-polished surface by using a polishing cloth having a lower sink rate of the semiconductor wafer.

The degree of polishing of the light polished surface is not limited.

In addition to this aspect, the present invention as defined in claim 7 provides a method of manufacturing a semiconductor wafer in accordance with any one of claims 1 through 9, in which the semiconductor wafer is coated with an oxide film on either one of the surfaces thereof.

The type of the oxide film is not limited. The oxide film includes, for example, a silicon oxide film used in the silicon wafer. The thickness of the oxide film is also not limited. The wafer surface coated with this oxide film may be polished to form a satin-finished surface or may not be polished thus to remain as a non-polished surface.

Besides, the present invention as defined in the third embodiment provides a method of manufacturing a semiconductor wafer, in which a semiconductor wafer is held in a wafer holding hole formed in a carrier plate, and the carrier plate is driven to make a motion within a plane parallel with a surface of the carrier plate between an upper surface plate and a lower surface plate, each having polishing cloth extended thereon and also being adapted to rotate around own rotation axis respectively, while supplying a slurry containing abrasive grains to the semiconductor wafer, so that a front and a back surfaces of the semiconductor wafer can be polished simultaneously, said method further characterized in that a rotating speed of the upper surface plate is differentiated from a rotating speed of the lower surface plate so as to differentiate a glossiness of the front surface of the semiconductor wafer from that of the back surface thereof.

The rotating speed of the upper surface plate and that of the lower surface plate are not limited. For example, the rotating speed of either one of the surface plates to be rotated at a lower speed may be varied within a range of 5-15 rpm, while the rotating speed of the other surface plate to be rotated at a higher speed may be varied in a range of 20-30 rpm. The ratio of the rotating speed between those of the upper and the lower surface plates at this occasion is also not limited. For example, the ratio may be in a range of 1:4 to 1:5. It is also appreciated that the either one of the surfaces of the wafer may be exclusively polished by not rotating either one of the surface plates (i.e., rotating at the rotating speed of 0).

In addition, the present invention as defined in FIG. 1 provides a method of manufacturing a semiconductor wafer in accordance with the third embodiment, in which the motion of the carrier plate is a circular motion associated with no rotation on its own axis.

In another aspect, the present invention as defined in FIG. 1 provides a method of manufacturing a semiconductor wafer in accordance with the third embodiment, in which the semiconductor wafer is coated with an oxide film on either one of the surfaces thereof.

The present invention as defined in the third embodiment provides a method of manufacturing a semiconductor wafer, in which a semiconductor wafer is held in a wafer holding hole formed in a carrier plate, and the carrier plate is driven to make a motion within a plane parallel with a surface of the carrier plate between a pair of polishing members disposed to face to each other, while supplying a polishing agent to the semiconductor wafer, so that a front and a back surfaces of the semiconductor wafer can be polished simultaneously, said method further characterized in that either one of the polishing members is made of bonded abrasive body having bonded abrasive grains and the other of the polishing members is made of polishing surface plate with a polishing cloth extended over a surface thereof facing to said bonded abrasive body so as to differentiate a quantity to be polished off from the semiconductor wafer between the front surface and the back surface thereof.

The semiconductor wafer may include a silicon wafer, a gallium arsenide wafer and so on. The semiconductor wafer may be such a wafer having a large diameter, including, for example, a 300 mm wafer. The semiconductor wafer may be coated with an oxide film on either one of the surfaces. In that case, a bare wafer surface in the opposite side to the oxide film of the semiconductor wafer may be selectively polished.

The double-sided polisher to be used is not limited but may be any doubled-sided polisher with no sun gear in so far as it includes no sun gear incorporated therein and allows the carrier plate to make a motion between a pair of polishing members thereby polishing simultaneously the front and the back surfaces of the semiconductor wafer.

The number of wafer holding holes formed in the carrier plate may be only one or may be more. The size of the wafer holding hole may be modified arbitrarily depending on the size of the semiconductor wafer to be polished.

The motion of the carrier plate may be any motion in so far as it is within the plane parallel with the front (or the back) surface of the carrier plate and other conditions, such as the direction of the motion, may not be limited. For example, it may be such a circular motion of the carrier plate associated with no rotation on its own axis, in which the silicon wafer held between the pair of polishing members may be caused to rotate within its corresponding wafer holding hole. In addition, the motion of the carrier plate may also include a circular motion around its centerline, a circular motion at an eccentric position, or a linear motion. In case of the linear motion, it is preferable that the upper and lower surface plates are rotated around respective axis lines in order to achieve uniform polishing of the front and the back surfaces of the wafer.

The type of the polishing agent to be used it not limited. For example, an alkaline liquid containing no loose abrasive grain may be solely used. Alternatively, the polishing agent may be a slurry of this alkaline liquid containing an mount of diffused particles of colloidal silica (abrasive grains) with an averaged grain size in a range of 0.02-0.1 μm. It is to be noted that the alkaline liquid containing no loose abrasive grain is more preferable because in this case the bonded abrasive body has been employed as one of the polishing members.

A quantity of the polishing agent to be supplied is not limited but may be varied depending on the size of the carrier plate. In one example, the polishing agent is supplied at a rate of 1.0-2.0 litter/min. The polishing agent may be supplied to the mirror-finished surface side of the semiconductor wafer. It is to be noted that preferably, the polishing agent should be rather supplied within an extent of the motion of the wafer.

The speed of rotation of each polishing member is not limited. They may be rotated at the same speed or at different speeds from each other. Further, the direction of the rotation is also not limited. In specific, they may be rotated in the same direction or rotated inversely to each other. In this regard, the pair of polishing members is not necessarily rotated together at the same time. This is because the present invention has employed such a configuration in which the carrier plate is driven to make a motion in a state where respective polishing members are pressed against the front and the back surfaces of the semiconductor wafer.

The pressure of each polishing member to be applied against the semiconductor wafer is not limited. For example, the pressure of 150-250 g/cm$^2$ may be used.

The surface of the semiconductor wafer which is selectively polished is not limited. Further, the quantity to be polished off from the front or the back surface of the wafer is also not limited. For example, in case where the wafer is a one-side mirror-polished wafer having the back surface thereof to be formed into a satin-finished surface, the quantity to be polished off from the surface to be formed into mirror-finished surface (the front surface of the wafer) is in a range of 5-20 μm and that of the surface to be formed into satin-finished surface is not greater than 1 μm. In this way, by carrying out the selective polishing to provide a greater quantity of polishing applied to one surface than the other surface, the glossiness may be differentiated between the front and the back surfaces of the wafer.

The type of the bonded abrasive body is not limited. For example, the bonded abrasive body may includes an abrasive wheel composed of bonded abrasive formed into a predetermined shape such as a thick disc-like shape by bond, an abrasive tape composed of base tape with the bonded abrasive grains secured by bond onto a front surface and/or a back surface thereof, and an abrasive material composed of fine powders of silica, fine powder of ceria and/or fine powder of alumina, which have been molded into a predetermined shape and then baked.

A grain size of the bonded abrasive grain is not limited. For example, the grain size may be in a range of 0.1-3.0 μm.

The type and material of respective polishing cloths to be extended over the polishing members are not limited. For example, a hard pad of expanded urethane foam or a soft pad of non-woven fabric impregnated with urethane resin and then set therewith may be used. In addition, such a pad composed of base fabric made of non-woven fabric and urethane resin expanded on the base fabric may be used.

The present invention as defined in FIG. 13 provides a method of manufacturing a semiconductor wafer in accordance with the third embodiment, in which the polishing agent is an alkaline liquid.

This alkaline liquid includes no loose abrasive grain. Further, the type of the alkaline liquid is not limited. The alkaline liquid includes, for example, NaOH, KOH and piperazine. The pH value of this alkaline agent is no limited. For example, the pH of 9-11 may be used.

The present invention as defined in the fifth embodiment provides a method of manufacturing a semiconductor wafer in accordance with the third embodiment, in which the bonded abrasive body is composed of an abrasive wheel and the polishing cloth is composed of a soft non-woven fabric pad made of non-woven fabric impregnated with urethane resin and then set therewith.

The present invention as defined in FIG. 1 provides a method of manufacturing a semiconductor wafer in accordance with the third embodiment through the fifth embodiment, in which the motion of the carrier plate is a circular motion of the carrier plate associated with no rotation on its own axis.

The circular motion of the carrier plate associated with no rotation on its own axis in this context refers to such a circular motion that the carrier plate is revolved while keeping always an eccentric condition by a predetermined distance with respect to an axis line of the upper and the lower surface plates. Because of the circular motion of the carrier plate associated with no rotation on its own axis, all the points on the carrier plate can be controlled to trace the same sized small circular orbit.

The present invention as defined in FIG. 14 provides a method of manufacturing a semiconductor wafer comprising the steps of: an alkaline etching step for etching a semiconductor wafer after having been finished with a lapping process by using an alkaline etchant; a surface grinding step, after the alkaline etching step, for applying a low-damage grinding to a front surface of the semiconductor wafer by using a grinding wheel for lower damaging; and a double-sided polishing step, after the surface grinding step having been finished, for applying a mirror-polishing to the front surface of the semiconductor wafer, while applying a light-polishing to a back surface of the semiconductor wafer so as to lightly polish the back surface having concavity and convexity formed thereon by said alkaline etching.

The alkaline etchant may includes, for example, the solution of KOH, NaOH and so on. A quantity to be etched off in this step may be in a range of 15-30 μm as a total quantity of etching for front and back surfaces of the wafer.

Then, in the surface grinding step for grinding the front surface, during finishing thereof, the low damage surface grinding is carried out. This may be only a finishing surface grinding, or may be a combination of the primary surface grinding for providing a relatively rough grinding and the finishing surface grinding. Further, a secondary and a tertiary grinding process may be interposed between the primary and the finishing surface grinding processes.

The quantity to be ground off in this surface grinding is in a range of 3-15 μm. As for the grinding wheel incorporated in the surface grinder used in finishing, for example, a resinoid grinding wheel may be employed. In this finishing surface grinding step, preferably a grinding wheel of higher number should be used, which can provide a moderate grinding to the surface of the wafer and advantageously can grind even the non-damage surface. In one specific example, the resinoid grinding wheel of #1000-#8000, preferably the resinoid grinding wheel of #2000-#4000 may be used.

The resinoid grinding stone of #1500-#3000 manufactured, for example, by Disco Co., Ltd. may be listed as one of the good examples of the grinding wheel. Especially, "IF-01-1-4/6-B-M01" (the brand name of the grinding stone) is preferred.

Besides, for the primary surface grinding, a vitrified grinding wheel of #300-#600 may be used.

The process damage after the surface grinding may be, for example, in a range of 1-3 μm. As the damage is greater, the quantity to be polished off from the surface of the wafer during subsequent double-sided polishing is increased. If the quantity of polishing is greater than 10 μm, problematically the polishing time may be longer and additionally there will be a fear that the back surface is polished excessively thus to form a complete mirror surface.

In this invention, since the lower damaged grinding is applied to the front surface of the wafer before the front and the back surfaces of the wafer are polished simultaneously, therefore the quantity to be polished off from the front surface of the wafer can be reduced to 10 μm or less (in one example, to about 7 μm). Accordingly, the polishing time may be shortened and thus the throughput is increased. In addition, this can prevent the back surface of the wafer from being polished excessively to be formed into a complete mirror surface.

The quantity to be polished off from the front surface of the wafer in the double-sided polishing step is not limited. The quantity of polishing may be lower than 12 μm, which has been a typical value in the prior art. For example, it may be 7 μm. The polishing cloth to be used includes, for example, a hard expanded urethane foam pad and a pad of non-woven fabric impregnated with the urethane resin and then set therewith.

The term, "a high degree of flatness in the surface of the wafer" refers to such a site flatness that, for example, in a site having an area of 25 mm×25 mm, a height difference measured from the back surface as a reference level (Global Backside Ideal Range: GBIR) is equal to or less than 0.3 μm.

Also, the polishing of the back surface of the wafer in this double-sided polishing step means that the back surface of the semiconductor wafer with concavity and convexity formed thereon by the alkaline etching is lightly polished to remove a part of the concavity and convexity so as to form the back surface of the wafer into a semi-mirror surface.

The quantity to be polished off from the back surface of the wafer is typically in a range of 0.5-1.5 μm. Further, respective polishing cloths as defined above for the front surface of the wafer may be used as the polishing cloth.

Besides, the method for providing the semi-mirror polishing to the back surface of the wafer while simultaneously applying the mirror polishing to the front surface of the wafer is not limited. For example, such a method may be employer in which, by way of example, the polishing rate in the front surface of the wafer by the polishing cloth prepared for the front surface of the wafer is differentiated from the polishing rate in the back surface of the wafer by the polishing cloth prepared for the back surface of the wafer.

The double-sided polisher used in the double-sided polishing step may include, for example, the LDP-300 (the name of the equipment) manufactured by Nachi-Fujikoshi Corporation.

The present invention as defined in the sixth embodiment provides a method of manufacturing a semiconductor wafer in accordance with FIG. 4, in which a quantity to be polished off from the front surface of the semiconductor wafer during the double-sided polishing step is in a range of 3-10 μm and that from the back surface of the semiconductor wafer is in a range of 0.5-1.5 μm.

With the quantity of polishing less than 3 μm, damage will still remain in the front surface. In contrast, with the quantity of polishing greater than 10 μm, the polishing time will be longer thus to decrease the throughput.

Further, the quantity of polishing lower than 0.5 μm in the back surface of the wafer will be insufficient to provide an effect on reducing the roughness in the back surface. Further, with the quantity of polishing greater than 1.5 μm, disadvantageously, identifying of the front surface and the back surface based on the mirror-finished condition is no more effective.

From the above consideration, the quantity of polishing defined in the range of 3-10 μm for the front surface of the wafer and that defined in the range of 0.5-1.5 μm for the back surface of the wafer allow for identifying of the front and the back surfaces of the wafer based on the intensities (glossiness) observed in the front and the back surfaces of the wafer by using a sensor.

The present invention as defined in the sixth embodiment provides a method of manufacturing a semiconductor wafer in accordance with FIG. 14, in which, in the double-sided polishing step, the semiconductor wafer is held in a wafer holding hole formed in a carrier plate, and the carrier plate is driven to make a motion within a plane parallel with a surface of the carrier plate between an upper surface plate and a lower surface plate having polishing cloths extended thereon respectively, while supplying a slurry containing abrasive grains to the semiconductor wafer, so that the front surface and the back surface of the semiconductor wafer can be polished simultaneously.

According to the present invention as defined in FIG. 1, in the double-sided polisher, the carrier plate is driven to make a motion within the plane parallel with the surface of the carrier plate between the upper surface plate and the lower surface plate, while supplying the slurry to the semiconductor wafer. By way of this, either one or both of the surfaces of the semiconductor wafer can be polished.

Upon this process, since either one of the polishing cloths extended on the upper and the lower surface plate has been specified to has the sink rate of the semiconductor wafer different from the other, the wafer can be polished so as to provide the different glossiness between the front surface and the back surface of the wafer by using the double-sided polisher with no sun gear.

Further, according to the present invention as defined in claims 1 through 7, such a semiconductor wafer having the front and the back surfaces provided with different glossiness from each other can be obtained selectively yet with a lower cost by using the double-sided polisher with no sun gear.

Especially, according to the present invention as defined in claims the first embodiment and FIG. 1, the semiconductor wafer is held between the upper and the lower surface plates, and while keeping this state, the carrier plate is driven to make a circular motion associated with no rotation on its own axis so as to polish the surfaces of the wafer. Because of the circular motion of the carrier plate associated with no rotation on its own axis, all the points on the carrier plate can be controlled to trace the same sized small circular orbit. This could be called as a kind of reciprocating motion. Specifically, it could also be considered that the orbit of the reciprocating motion traces a circle. Due to such a motion of the carrier plate, the wafer can be polished while rotating in the wafer holding hole during being polished. By way of this, the uniform polishing can be accomplished over approximately entire region on the polished surface of the wafer. This also can help reduce, for example, the polish-sagging in the outer periphery of the wafer.

Further, according to the present invention as defined in claims 3 through 6, the semiconductor wafer is polished by using two types of polishing cloths which are different from each other in hardness, density, compressibility or elastic modulus in compression. This may differentiate the sink rate of the semiconductor wafer between two types of polishing cloths in a simple and cost effective manner. Further, this inventive method may advantageously be applicable to the conventional double-sided polisher with sun gear in simple and cost effective manner by such a simple modification that the polishing cloths on the upper and the lower surface plates are replaced with different ones.

Yet, according to the present invention as defined in claim 7, since in the double-sided polishing of the semiconductor wafer, the expanded urethane foam pad and the non-woven fabric pad are extended over the upper surface plate and the lower surface plate respectively, such a preferred semiconductor wafer can be obtained that has one surface formed into the mirror-finished surface and the other surface formed into the satin-finished surface.

According to the present invention as defined in claim 7, a mirror-finished wafer of high precision having one surface formed into the satin-finished surface can be obtained.

Further, according to the present invention as defined in claim 8, during polishing of the wafer, the slurry is supplied from a location right above the wafer holding hole of the carrier plate. As a result, the slurry can be supplied directly to the semiconductor wafer.

Also, according to the present invention as defined in claim 9, either one of the front surface and the back surface of the semiconductor wafer can be formed into a light-polished surface by lightly polishing it with the polishing cloth having a lower sink rate of the semiconductor wafer.

Further, according to the present invention as defined in claim 7 as well as the invention as defined in FIG. 1, either one of the surfaces of the semiconductor wafer is coated with the oxide film. Accordingly, the bare silicon surface located opposite to the oxide film can be polished to a predetermined degree. This enables the bare silicon surface to be polished to form a surface having an arbitrary glossiness.

Further, according to the present invention as defined in the third embodiment, the carrier plate is driven to make a motion within a plane parallel with the surface of the carrier plate between the upper and the lower surface plates in the double-sided polisher with no sun gear, while supplying the slurry to the semiconductor wafer. This enables the front surface and/or the back surface to be polished with the polishing cloth(s).

At that time, the rotating speed of either one of the upper and the lower surface plate is set to be different from that of the other surface plate. This enables the polishing of the wafer resultantly having different glossiness between the front and the back surfaces thereof by using the double-sided polisher with no sun gear.

According to the present invention as defined in the third embodiment, such a semiconductor wafer having the front and the back surfaces provided with different glossiness from each other can be obtained selectively and yet with a lower cost by using the double-sided polisher with no sun gear.

Further, since the present invention has been configured such that the rotating speed is differentiated between the upper and the lower surface plates, therefore the present invention may advantageously be applicable even to the existing double-sided polisher with sun gear yet in simple and cost effective manner.

According to the present invention as defined in the third embodiment and FIG. 1, the carrier plate is driven to make a motion within a plane parallel with the surface of the carrier plate between the bonded abrasive body and the polishing cloth while supplying the polishing agent to the semiconductor wafer. Thereby, both of the front and the back surfaces of the semiconductor wafer are polished by those bonded abrasive body and the polishing cloth.

At that time, a selective polishing is applied to either one of the front and the back surface of the wafer such that the quantity to be polished off from either one of the surfaces may be increased by means of the bonded abrasive body or the polishing cloth. In specific, a difference is created between the quantity to be polished off from one of the surfaces of the wafer by the bonded abrasive body such as an abrasive roller and that from the other of the surfaces by the polishing cloth. Consequently, by using this double-sided polisher with no sun gear, both surfaces of the wafer can be polished so as to have the difference in glossiness between the front and the back surfaces thereof.

Especially according to the present invention as defined in FIG. 13, the alkaline liquid containing no abrasive grains is used as the polishing agent during the double-sided polishing of the wafer. This can help improve the degree of flatness measured in the mirror-finished surface of the wafer.

Further, according to the present invention as defined in FIG. 1, the semiconductor wafer is held between the bonded abrasive body and the surface plate, and while keeping this state, the carrier plate is driven to make a circular motion associated with no rotation on its own axis thus to polish the surfaces of the wafer. Because of the circular motion of the carrier plate associated with no rotation on its own axis, all the points on the carrier plate can be controlled to trace the same sized small circular orbit. This could be called as a kind of reciprocating motion. Specifically, it could also be considered that the orbit of the reciprocating motion traces a circle. Due to such a motion of the carrier plate, the wafer can be polished while rotating in the wafer holding hole during being polished. By way of this, the uniform polishing can be accomplished over approximately entire region on the polished surface of the wafer. This also can help reduce, for example, the polish-sagging in the outer periphery of the wafer.

According to the present invention as defined in FIG. 14 and the sixth embodiment, the lapped wafer is subjected to the alkaline etching so as to provide the low-damage surface grinding to the front surface of the wafer. This surface grinding can reduce the quantity to be polished off from the front surface of the wafer in the subsequent step of double-sided polishing to less than 10 μm. Since the quantity to be polished off from the front surface of the wafer having low grinding damage is reduced to be less than 10 μm, the quantity to be polished off can be reduced and also the polishing time may be shortened.

After the grinding of the front surface, the back surface of the wafer is lightly polished while at the same time the front surface of the wafer being mirror-polished. This can prevent the coarse surface with concavity and convexity to be formed in the back surface of the wafer. Further, this can facilitate the identifying of the back surface in the subsequent device fabricating step. In addition, this can help eliminate the occurrence of nanotopography. The nano-topography refers to a waviness at 20-30 mm intervals on the surface of the silicon wafer created by the acid etching.

According to the present invention as defined in FIG. 14 and the sixth embodiment, the coarse surface with concavity and convexity can be prevent from being formed on the back surface of the wafer, thereby reducing the impurities adhering to the back surface. In addition, since after the double-sided polishing having been applied to the wafer, the back surface of the wafer would not be fully mirror-polished, the sensor can be used effectively to distinguish the front surface of the wafer from the back surface thereof.

Further, since the present invention can reduce the quantity to be polished off from the front surface of the wafer, the throughput in the polishing step can be improved. Still further, since the present invention suppresses the occurrence of the waviness in the back surface of the wafer by the alkaline etching thus to prevent the waviness from being transferred to the mirror-finished surface, the deterioration in the resolution of exposure in the device fabricating step can be prevented.

Further, since the occurrence of the nanotopography can be prevented by the double-sided polishing, the decrease in device yield due to the unfavorable deviation of film thickness in the CMP (Chemical Mechanical Polishing) step may also be prevented.

PREFERRED EMBODIMENTS FOR IMPLEMENTING THE PRESENT INVENTION

Preferred embodiments of the present invention will now be described with reference to the attached drawings. FIGS. 1 through 6 are provided to illustrate a first embodiment according to the present invention. The first embodiment will be described by taking as an example a polishing of a silicon wafer with its front surface formed into a mirror-finished surface and its back surface formed into a satin-finished surface.

Figure 1:
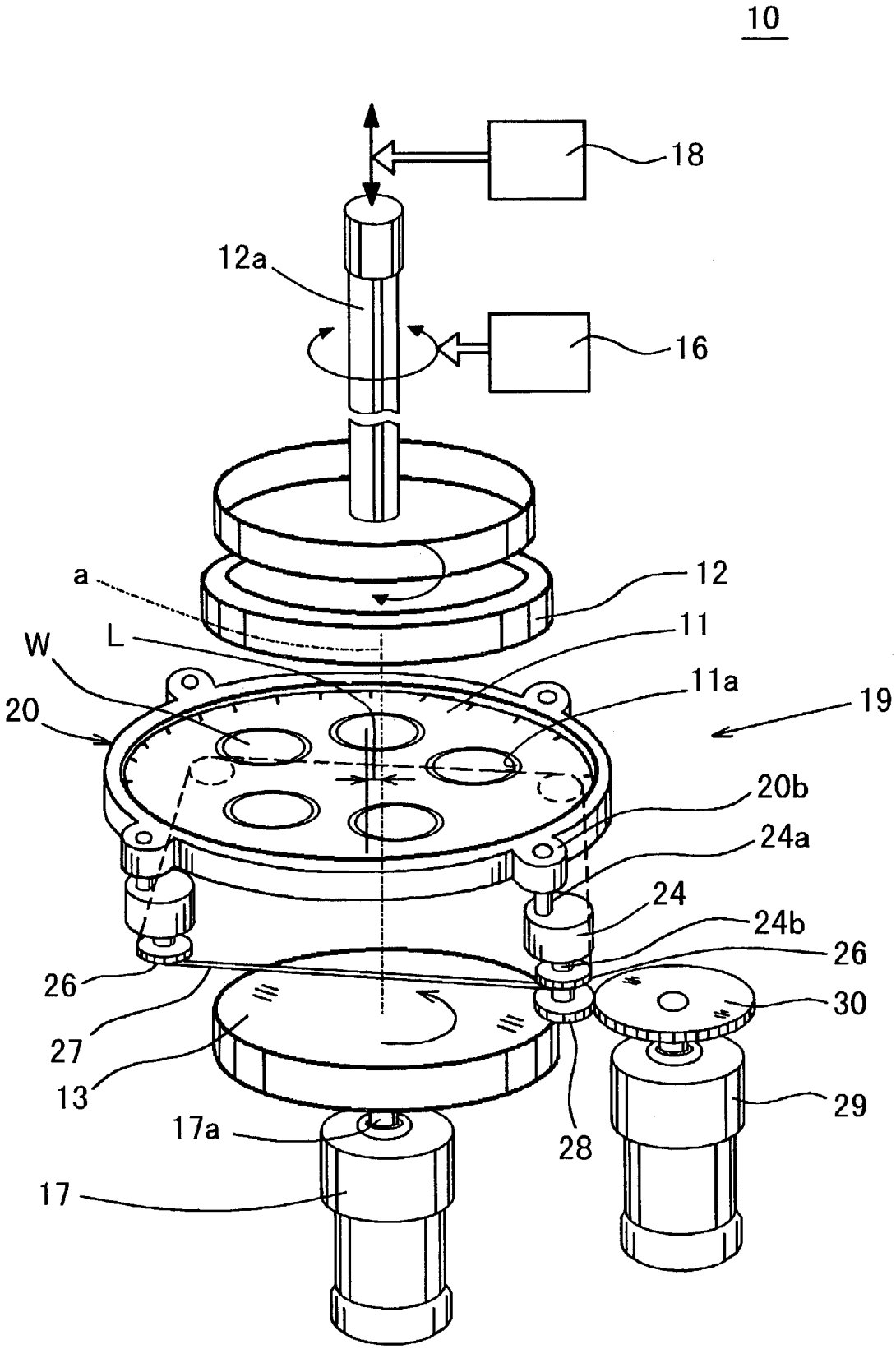
FIG. 1 is a perspective view illustrating a general configuration of a double-sided polisher according to a first embodiment of the present invention.
Figure 2:
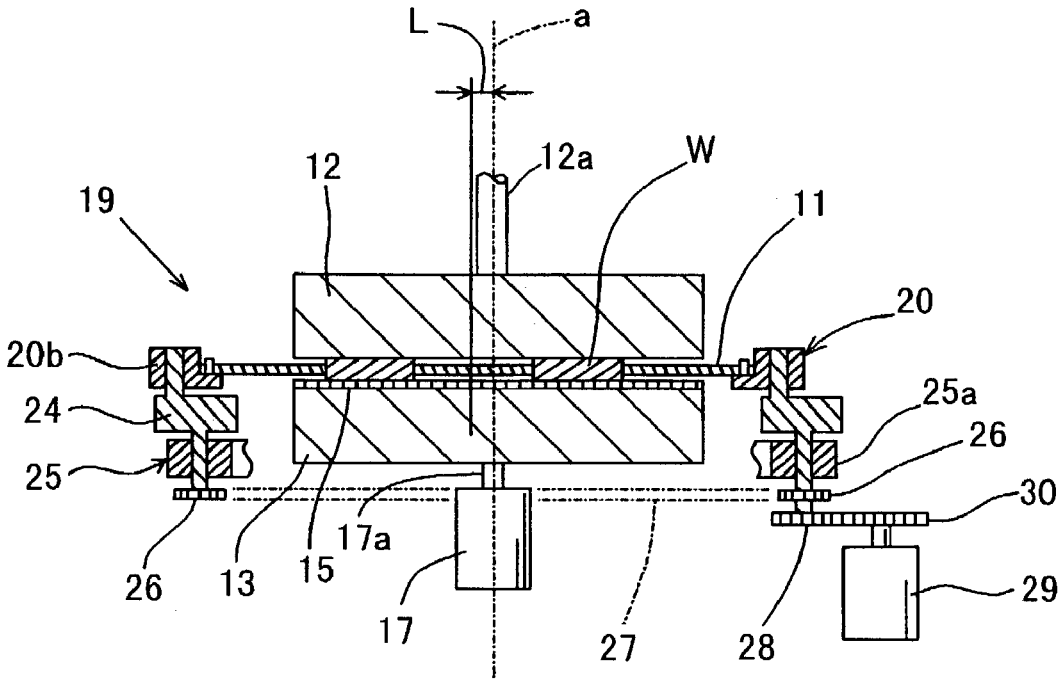
FIG. 2 is a longitudinal sectional view illustrating a double-sided polishing process in a method of manufacturing a semiconductor wafer according to the first embodiment of the present invention.

In FIG. 1 and FIG. 2, reference numeral 10 generally designates a double-sided polisher used in a method of manufacturing a semiconductor wafer according to the first embodiment of the present invention. This double-sided polisher 10 comprises a carrier plate 11 made of epoxy-glass having a circular disc-like shape in plan view in which five of wafer holding holes 11*a* have been formed by every 72 degrees (in the circumferential direction) around an axis line of the plate so as to penetrate through the plate, and a pair of upper surface plate 12 and lower surface plate 13 functioning for clamping silicon wafers "W", each having a diameter of 300 mm and having inserted and thus held operatively in the wafer holding hole 11*a* so as to be free to rotate therein, from above and below sides with respect to the wafers W and also functioning for polishing the surfaces of the wafers W by moving themselves relatively with respect to the silicon wafers W. The carrier plate 11 is disposed between the upper surface plate 12 and the lower surface plate 13. The silicon wafer W may have either one of the surfaces coated with an oxide film. Further, a thickness of the carrier plate 11 (600 μm) is made to be a little thinner than that of the silicon wafer W (730 μm).

Figure 3:
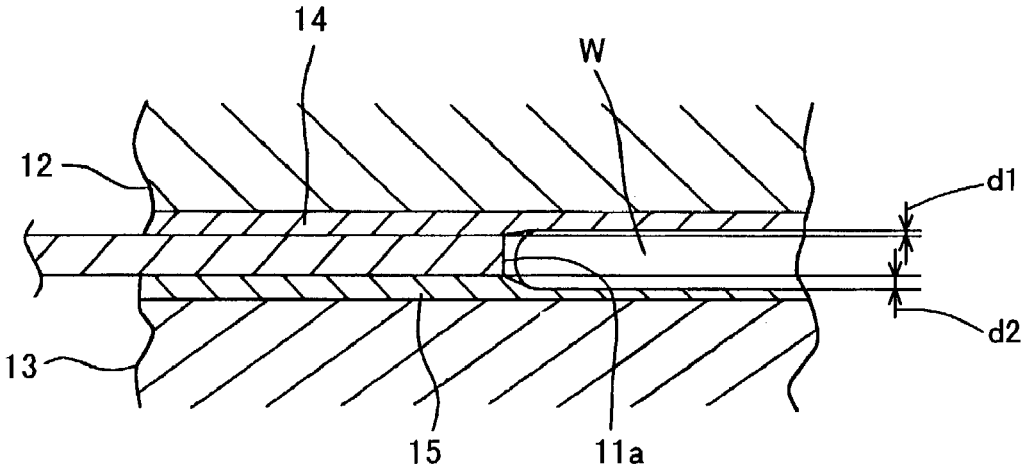
FIG. 3 is a sectional view illustrating a polishing process in a method of polishing a semiconductor wafer according to the first embodiment of the present invention.
Figure 4:
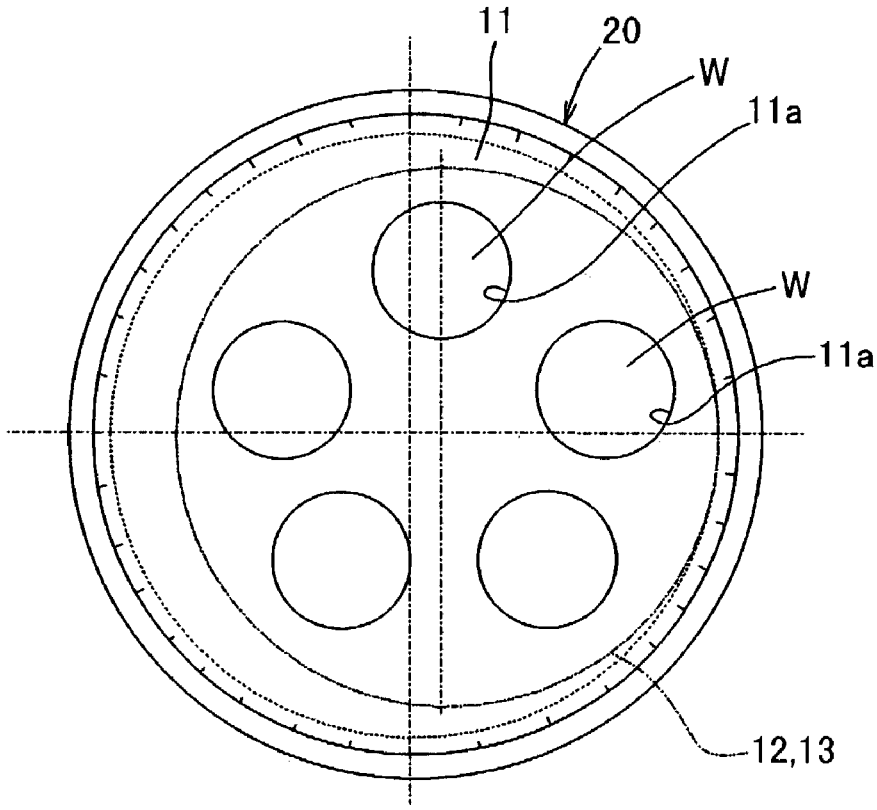
FIG. 4 is a plan view illustrating a general configuration of the double-sided polisher according to the first embodiment of the present invention.

A hard pad of expanded urethane foam 14 is extended over an under surface of the upper surface plate 12 for polishing the back surface of the wafer to form it into a satin-finished surface. On the other hand, a soft non-woven fabric pad 15 made of non-woven fabric impregnated with urethane resin and then set therewith is extended over a top surface of the lower surface plate 13 for polishing the front surface of the wafer to form it into a mirror-finished surface (FIG. 3). The hard expanded urethane foam pad 14 (MHS15A manufactured by Rodale Inc.) has a hardness of 85° (measured by Asker hardness meter), a density of 0.53 g/cm$^3$, a compressibility of 3.0% and a thickness of 1000 μm. On one hand, the soft non-woven fabric pad 15 (Suba600 manufactured by Rodale Inc.) has a hardness of 80° (measured by Asker hardness meter), a compressibility of 3.5%, an elastic modulus in compression of 75% and a thickness of 1270 μm. As described above, the hard expanded urethane foam pad 14 on the upper surface plate 12 is harder and inevitably makes it difficult for the silicon wafer W to sink down into the pad 14 during double-sided polishing of the wafer under a predetermined polishing pressure, while in contrast, the soft non-woven fabric pad 15 is softer and consequently makes it rather easier for the silicon wafer W to sink down into the pad 15 during the double-sided polishing of the wafer.

It is to be appreciated that in a comparison between the hard expanded urethane foam pad 14 and the soft non-woven fabric pad 15 with respect to the density, the compressibility and the elastic modulus in compression, the hard expanded urethane foam pad 14 has a higher density, a higher compressibility and a lower elastic modulus in compression, creating a favorable condition for preventing the silicon wafer W from sinking deeper into the pad.

It is also clearly seen from FIG. 3. In specific, the sink rate d2 defined in the soft non-woven fabric pad 15 is observed greater than the sink rate d1 defined in the hard expanded urethane foam pad 14.

Referring briefly to a retaining ability of the slurry containing abrasive grains with respect to respective pads 14 and 15, it is a matter of course that the soft non-woven fabric pad 15 has rather greater slurry retaining ability as compared to the hard expanded urethane foam pad 14. The greater the slurry retaining ability is, the more the abrasive grains attach to the surface of the pad, thereby increasing the polishing rate.

As shown in FIG. 1 and FIG. 2, the upper surface plate 12 is driven to rotate within a horizontal plane by an upper rotary motor 16 via a rotary shaft 12*a* extending upwardly. Further, the upper surface plate 12 is moved up or down in a vertical direction by a lifting device 18 which advances or retracts it along its axial direction. This lifting device 18 is used when the silicon wafer W is to be supplied or removed to/from the carrier plate 11. It is to be appreciated that pushing pressures of the upper surface plate 12 and the lower surface plate 13 applied onto the front and the back surfaces of the silicon wafer W may be generated by pressurizing means by way of, for example, air bag system incorporated in the upper and the lower surface plates 12 and 13, though not shown.

The lower surface plate 13 is driven to rotate within a horizontal plane by a lower rotary motor 17 via its output shaft 17*a*.

The carrier plate 11 is driven to make a circular motion within a plane parallel with an upper and an under surfaces of the carrier plate 11 (i.e., horizontal plane) by a carrier circular motion mechanism 19 in such a manner that the plate 11 may not make the rotation on its own axis.

The carrier circular motion mechanism 19 will now be described in detail with reference to FIG. 1, FIG. 2, FIG. 4, FIG. 5 and FIG. 6, respectively.

As shown in those drawings, the carrier circular motion mechanism 19 has an annular carrier holder 20, which secures the carrier plate 11 from the outer side thereof. Those members 11 and 20 are coupled to each other via a coupling structure 21. The coupling structure in this context refers to a means for coupling the carrier plate 11 to the carrier holder 20 in such a manner that the carrier plate 11 is not allowed to make a rotation on its own axis and also the elongation of the plate 11 due to thermal expansion should be absorbed.

Figure 5:
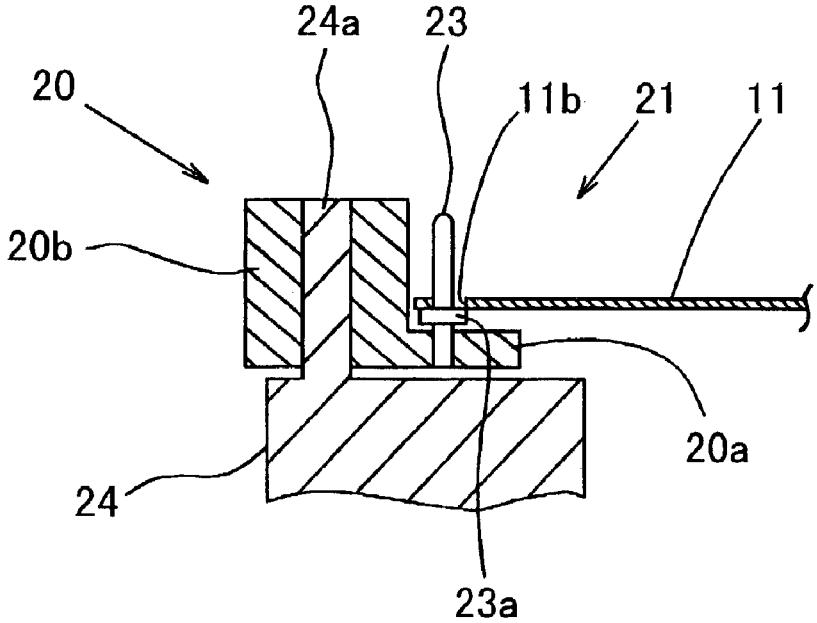
FIG. 5 is an enlarged sectional view of a main part of a driving force transmission system for transmitting a driving force to a carrier plate according to the first embodiment of the present invention.

Specifically, the coupling structure 21 includes, as shown in FIG. 5, a plurality of pins 23 arranged so as to project from an inner peripheral flange 20*a* of the carrier holder 20 by every predetermined angle along the circumference of the holder, and a plurality of elongated pin holes 11*b* with the number equivalent to said pins 23, which have been punched through the outer peripheral portion of the carrier plate 11 in the locations corresponding to said pins 23 for receiving corresponding pins 23 respectively.

Each of those pin holes 11*b* is formed so as for a longitudinal direction thereof to match up with a radial direction of the plate so that the carrier plate 11 coupled with the carrier holder 20 via those pins 23 is allowed to move in its radial direction by a small distance. In this configuration in which the carrier plate 11 is engaged with the carrier holder 20 by inserting the pins 23 into the pin holes 11*b* with some play left between them, the elongation of the carrier plate 11 caused by the thermal expansion during the double-sided polishing can be absorbed. It is to be noted that root portion of each pin 23 is screwed into a threaded hole formed in said inner peripheral flange 20*a* by way of an external thread formed on an outer surface of the root portion. Further, in a location immediately above the external thread section of each pin 23, a flange 23*a* is formed surrounding the pin 23 for loading the carrier plate 11 on said flange 23*a*. Therefore, by adjusting the length of screwing of the pin 23 into the threaded hole, the level of height of the carrier plate 11 loaded on the flange 23*a* can be adjusted.

This carrier holder 20 includes four bearing sections 20*b* projecting outward by every 90 degrees along the outer periphery of the carrier holder 20 (FIG. 1). An eccentric shaft 24*a* projecting from an eccentric location on a top surface of a disc shaped eccentric arm 24 having a small diameter is inserted into each of the bearing sections 20*b*. A rotary shaft 24*b* extends down from a central portion on an under surface of each of those four eccentric arms 24. Those rotary shafts 24*b* are respectively inserted through the total of four bearing sections 25*a* arranged by every 90 degrees in an annular base 25 of the apparatus, with top end portions of respective rotary shafts 24*b* projected beyond corresponding bearing sections 25*a*. Sprockets 26 are fixedly attached to the downwardly projected top end portions of the rotary shafts 24*b*, respectively. An endless timing chain 27 is installed so as to connect respective sprockets 26 within a horizontal plane. It is to be appreciated that this timing chain 27 may be replaced with a driving force transmission system composed of gear train. Those four sprockets 26 together with the timing chain 27 construct a synchronizing means for rotating all of those four rotary shafts 24*b* in the same timing so that those eccentric arms 24 are synchronous to one another to make circular motions.

Further, one of those four rotary shafts 24*b* is formed to be longer than others, so that the top end portion of this longer rotary shaft 24*b* is protruded downwardly beyond the sprocket 26. A gear 28 for transmitting the driving force is fixedly attached to that protruded portion of the rotary shaft 24*b*. This gear 28 is engaged with a driving gear 30 having a larger diameter and fixedly attached to an output shaft extending upward from a motor 29 for making a circular motion represented by a geared motor, for example. It is to be noted that the timing chain 27 may not be necessarily used for synchronizing the four eccentric arms 24 but, for example, the four eccentric arms 24 may be respectively provided with said motors 29 for circular motions, allowing each of four eccentric arms 24 to be rotated individually. In that case, it is a matter of course that the respective motors 29 must be controlled to make synchronous rotation to one another.

According to the mechanism described above, as the output shaft of the motor for the circular motion 29 is rotated, the turning force generated thereby is transmitted to the timing chain 27 via the gears 30, 28 and the sprocket 26 fixedly attached to the long rotary shaft 24*b*, and then the timing chain 27 is driven to run along a course supported by four sprockets 26, and finally all the four eccentric arms 24 are driven by respective sprockets 26 to synchronously rotate around respective rotary shafts 24*b* within the horizontal plane. By way of this, the carrier holder 20 operatively coupled with an assembly consisting of respective eccentric shafts 24*a* and thus the carrier plate 11 held by the carrier holder 20 can make the circular motion associated with no rotation on their own axes, within the horizontal plane parallel with the carrier plate 11. That is, the carrier plate 11 is revolved around an axis line "a" of the upper and the lower surface plates 12 and 13 while being held in an eccentric position therefrom by a distance "L". This distance L is equivalent to the distance between the eccentric shaft 24*a* and the rotary shaft 24*b*. Owing to this circular motion of the carrier plate 11 associated with no rotation on its own axis, every point on the carrier plate 11 may follow the orbit tracing the same sized small circle.

Figure 6:
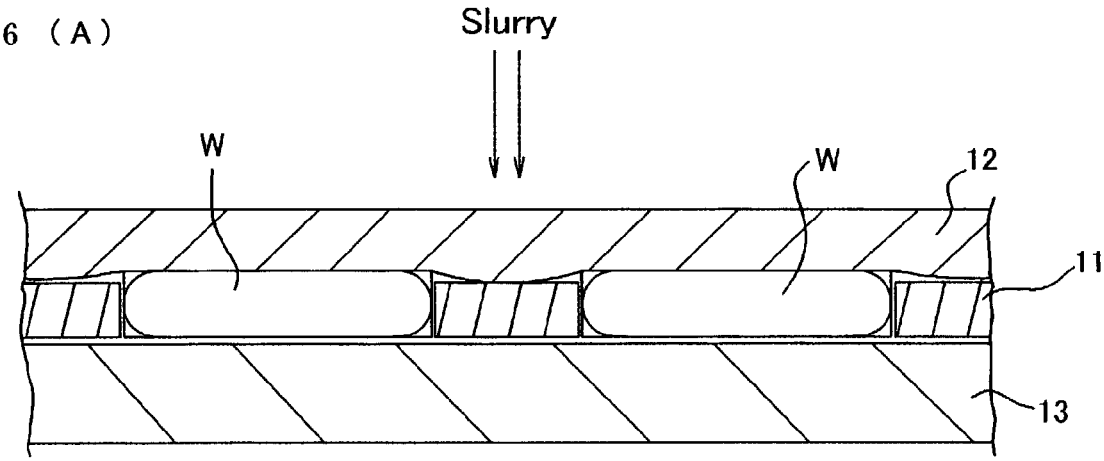
FIG. 6 shows a sectional view and a plan view indicating a location of a slurry supply hole according to the first embodiment of the present invention.
Figure 6:
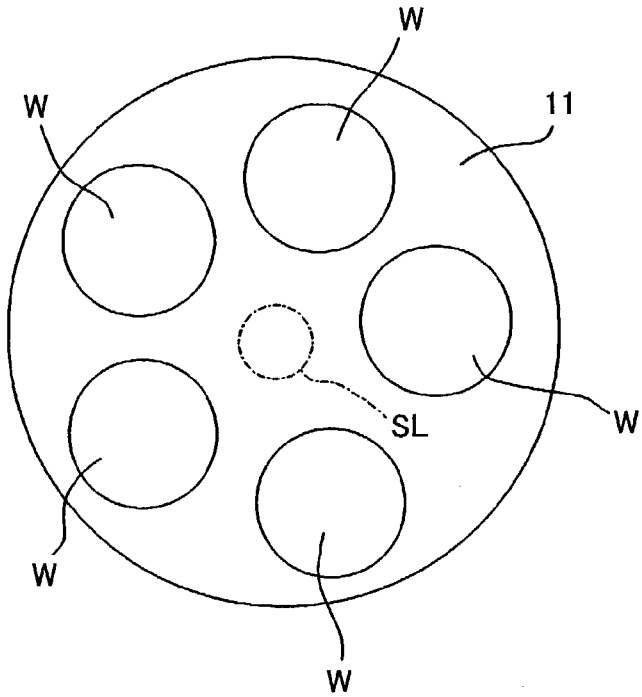

Further, FIG. 6 shows a location of a slurry supply hole in this apparatus. For example, a plurality of slurry supply holes formed in the upper surface plate 12 are located in a central region of the plurality of silicon wafers W. That is, the slurry supply holes (SL) are located in a central region of the upper surface plate 12, or in other words, in a central region of the carrier plate 11. As a result, the thin film formed by the slurry can be always maintained over the back surface of the silicon wafer W during polishing. Alternatively, the locations of the slurry supply holes may be right above the wafer holding holes. Or otherwise, the slurry supply holes may be located within an annular region having a predetermined width defined by respective wafer holding holes. This is because the slurry can be supplied directly to an area through which the silicon wafers is moved.

Then, a method of polishing the silicon wafer W by using this double-sided polisher 10 will be described.

At first, the silicon wafers W are inserted in respective wafer holding holes 11*a* of the carrier plate 11 so as to be free to rotate therein. At that time, each of the silicon wafers W is placed with its back surface facing up. Secondly, in this state, the hard expanded urethane foam pad 14 is pressed against the back surfaces of respective wafers at a pressure level of 200 g/cm$^2$, while the soft non-woven fabric pad 15 is pressed against the front surfaces of respective wafers at a pressure level of 200 g/cm$^2$.

Then, with the both pads 14, 15 being pressed against the front and the back surfaces of the wafers W, the timing chain 27 is driven to run along its course by the circular motion motor 29, while supplying the slurry from the upper surface plate 12 side. This causes all of the eccentric arms 24 to rotate synchronously within the horizontal plane, so that the carrier holder 20 held by the assembly of the eccentric shafts 24*a* and thus the carrier plate 11 make the circular motion associated with no rotation on their own axes at a speed of 24 rpm within the horizontal plane parallel with the surface of this carrier plate 11. As a result, respective silicon wafers W are polished in their both of the front and the back surfaces while being rotated in their corresponding wafer holding holes 11*a* within the horizontal plane. It is to be noted that the slurry used in this embodiment is an alkaline etchant of pH 10.6 containing an amount of diffused colloidal silica with an averaged grain size of 0.05 μm.

At that time, the sink rate of the silicon wafer W into the hard expanded urethane foam pad 14 of the upper surface plate 12 is smaller as compared with that into the soft non-woven fabric pad 15 of the lower surface plate 13. Therefore, in contrast with the double-sided polishing provided by using the prior art double-sided polisher with no sun gear, in which the same type of polishing cloths made of same material are extended on both of the upper and the lower surface plates, resulting in the same glossiness to be achieved always in both of the front and the back surfaces of the wafer through polishing, the double-sided polishing by the use of this double-sided polisher according to the first embodiment of the present invention can achieve such a double-sided polishing for forming simultaneously the front and the back surfaces having different glossiness from each other, in which the back surface of the wafer is formed into a satin-finished surface and the front surface of the wafer is formed into a mirror-finished surface.

Further, in this embodiment, both of the front and the back surfaces of the wafer are polished by driving the carrier plate 11 to make a circular motion associated with no rotation on its own axis during polishing of the wafer. Since such a special motion of the carrier plate 11 has been employed to polish the wafer in both surfaces, almost entire area in both of the front and the back surfaces of the wafer can be polished in a uniform manner.

Still further, since in the configuration of the apparatus according to the present invention, the materials of respective polishing cloths 14, 15 are differentiated from each other so as to make a difference in the sink rate of the silicon wafer W therebetween, therefore the silicon wafer having different glossiness between the front and the back surfaces of the wafer can be obtained in a simple manner with a lower cost. It is to be noted that in the front and the back surfaces of such a wafer having the glossiness different from each other, a predetermined level of flatness corresponding to different glossiness of each surface has been achieved.

It is to be also noted that the double-sided polisher 10 according to the first embodiment enables the double-sided polishing of each silicon wafer W simply by rotating the upper surface plate 12 at a speed of 5 rpm by the upper rotary motor 16, while rotating the lower surface plate 13 at 25 rpm by the lower rotary motor 17, yet without driving the carrier plate 11 to make any circular motion.

In this case, since respective silicon wafers W have been inserted and held in the wafer holding holes 11*a* so as to be free to rotate therein, therefore during polishing, respective wafers W follow and thus rotate (on their own axes) in the same direction as of the rotation of either one of the surface plates having a higher rotating speed. As discussed above, allowing the silicon wafers W to rotate on their own axes can eliminate such an effect on the polishing by the upper and the lower surface plates that the circumferential speed is getting higher as closing to the outer periphery of the wafer. This leads to the uniform polishing to be provided over an entire area of each one of the front and the back surfaces of the wafer respectively.

In this way, also by carrying out the double-sided polishing with the rotating speed of the upper surface plate 12 being differentiated from that of the lower surface plate 13, such a silicon wafer having the mirror-finished front surface and the satin-finished back surface is still obtainable by using the double-sided polisher with no sun gear. Further, the upper surface plate 12 and the lower surface plate 13 may be rotated at the same rotating speed thus to produce such a silicon wafer W having its front surface formed into the mirror-finished surface and its back surface formed into the satin-finished surface.

Alternatively, the upper surface plate 12 and the lower surface plate 13 may be rotated while allowing the carrier plate 11 to make a circular motion so as to carry out the double-sided polishing of the silicon wafer W. In this case, preferably the rotating speeds of the upper and the lower surface plates 12 and 13 are rather slowed down within a range in which uneven polishing would not be induced in both of the front and the back surfaces of the wafer. With this arrangement, both of the front and the back surfaces of the silicon wafer W can be polished uniformly over the entire area of respective surfaces. It is to be considered preferable that rotating the upper surface plate 12 and the lower surface plate 13 can provide new contact faces of the surface plates with respect to the silicon wafer W at any time, so that the slurry can be supplied to the entire surfaces of the silicon wafer W uniformly.

In this regard, the glossiness of the mirror-finished front surface and the satin-finished back surface of the silicon wafer W, which are created by the double-sided polishing of the silicon wafer W using the double-sided polisher with no sun gear 10 of the first embodiment based on the conditions for the double-sided polishing, were measured respectively. The result indicated that the glossiness of the mirror-finished front surface of the wafer was equal to or greater than 330% as measured by the measuring instrument from Nippon Denshoku Inc. In contrast to this, the glossiness of the back surface of the wafer fell in a range of 200-300%. It is to be noted that the silicon wafers, after having been polished, is cleaned according to the well known procedure.

Figure 7:
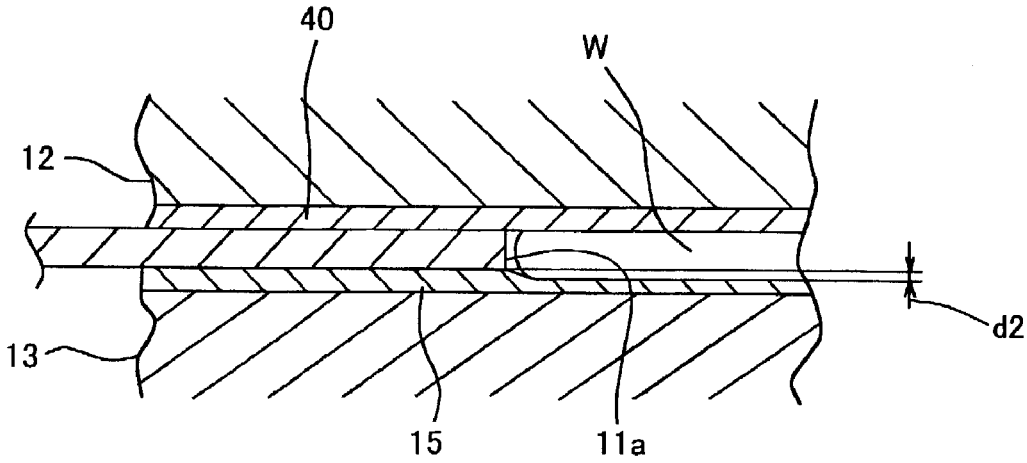
FIG. 7 is a sectional view illustrating a polishing process of a semiconductor wafer according to a second embodiment of the present invention.

Referring now to FIG. 7, a method of manufacturing semiconductor wafer according to a second embodiment of the present invention will now be described.

As shown in FIG. 7, this second embodiment is representative of an example that has employed, instead of the hard expanded urethane foam pad 14 extended over the upper surface plate 12 in the first embodiment, a hard plastic plate 40 which allows almost no slurry to attach to the surface thereof.

This configuration allows, during polishing process, exclusively the front surface of the silicon wafer W to sink into the soft non-woven fabric pad 15 at a sink rate of d2 and thus to be mirror-polished, while the back surface of the silicon wafer W, which is engaged with the hard plastic plate 40, may not be polished at all. By way of this, the silicon wafer may be finished with the waviness (nanotopography) created by the acid etching left in the back surface as it was.

Other description on configuration, operation and effect of this embodiment is almost same as in the first embodiment, which is herein accordingly omitted.

A method of manufacturing a semiconductor wafer according to a third embodiment of the present invention will now be described.

In the third embodiment, the polishing cloths extended over the upper surface plate 12 and the lower surface plate 13, as used in the first embodiment shown in FIG. 1, are specified as the same soft non-woven fabric pads 15, in which the upper surface plate 12 is driven by the upper rotary motor 16 to rotate at a lower speed (5 rpm), while the lower surface plate 13 is driven by the lower rotary motor 17 to rotate at a higher speed (25 rpm) to carry out a double-sided polishing. At that time, the slurry is supplied at a rate of 2.0 litter/min, and the quantity to be polished off from the front surface of the wafer is 10 μm and that from the back surface of the wafer is equal to or less than 1 μm.

With this arrangement, different polishing rates are created between the front and the back surfaces of the wafer, which in turn brings a difference in glossiness between the front and the back surfaces of the silicon wafer W. During this polishing, the carrier plate 11 is not driven to make the circular motion.

In practice, the silicon wafer W was double-side polished under those conditions as discussed above, and the test result indicates the polishing rate of 0.5 μm/min for the front surface of the wafer. At that time, the glossiness of the silicon wafer W obtained at this test was 330% or greater in the front surface of the wafer and 200-300% in the back surface of the wafer, indicating that the glossiness has decreased in the back surface of the wafer.

It is to be appreciated that either one of the polishing cloths extended on the upper surface plate 12 and on the lower surface plate 13 may have a different sink rate of the silicon wafer from the other.

Other description on configuration, operation and effect of this embodiment is almost same as in the first embodiment, which is herein accordingly omitted.

A method of manufacturing a semiconductor wafer according to a fourth embodiment of the present invention will now be described.

This fourth embodiment represents an example in which, as similar to the first embodiment, the carrier plate 11 is driven to make a circular motion associated with no rotation on its own axis during double-sided polishing of the wafers by using the upper and the lower surface plates 12, 13 specified in the third embodiment of the present invention.

The rate of this circular motion of the carrier plate 11 in this embodiment is 24 rpm. Further, in this embodiment, the rotating speeds of the upper and the lower surface plates 12, 13 are set to be 5 rpm and 25 rpm respectively. The slurry is supplied at a rate of 2.0 litter/min and the quantity to be polished off from the front surface of the wafer is 10 μm and that from the back surface of the wafer is equal to or less than 1 μm.

In practice, the silicon wafer W was double-side polished under those conditions as discussed above, and the test result indicates the polishing rate of 0.5 μm/min for the front surface of the wafer. At that time, the glossiness of the silicon wafer W obtained at this test was 330% or greater in the front surface of the wafer and 200-300% in the back surface of the wafer.

Other description on configuration, operation and effect of this embodiment is almost same as in the first embodiment, which is herein accordingly omitted.

Turning now to FIGS. 8 through 13, a fifth embodiment of the present invention will be described. This embodiment is explained by taking as an example such a polishing case where the front surface of the silicon wafer, which has been placed facing upward during the double-sided polishing, is polished to be formed into a mirror-finished surface and the back surface of the wafer, which has been placed as facing downward, is polished to be formed into a satin-finished surface.

Figure 8:
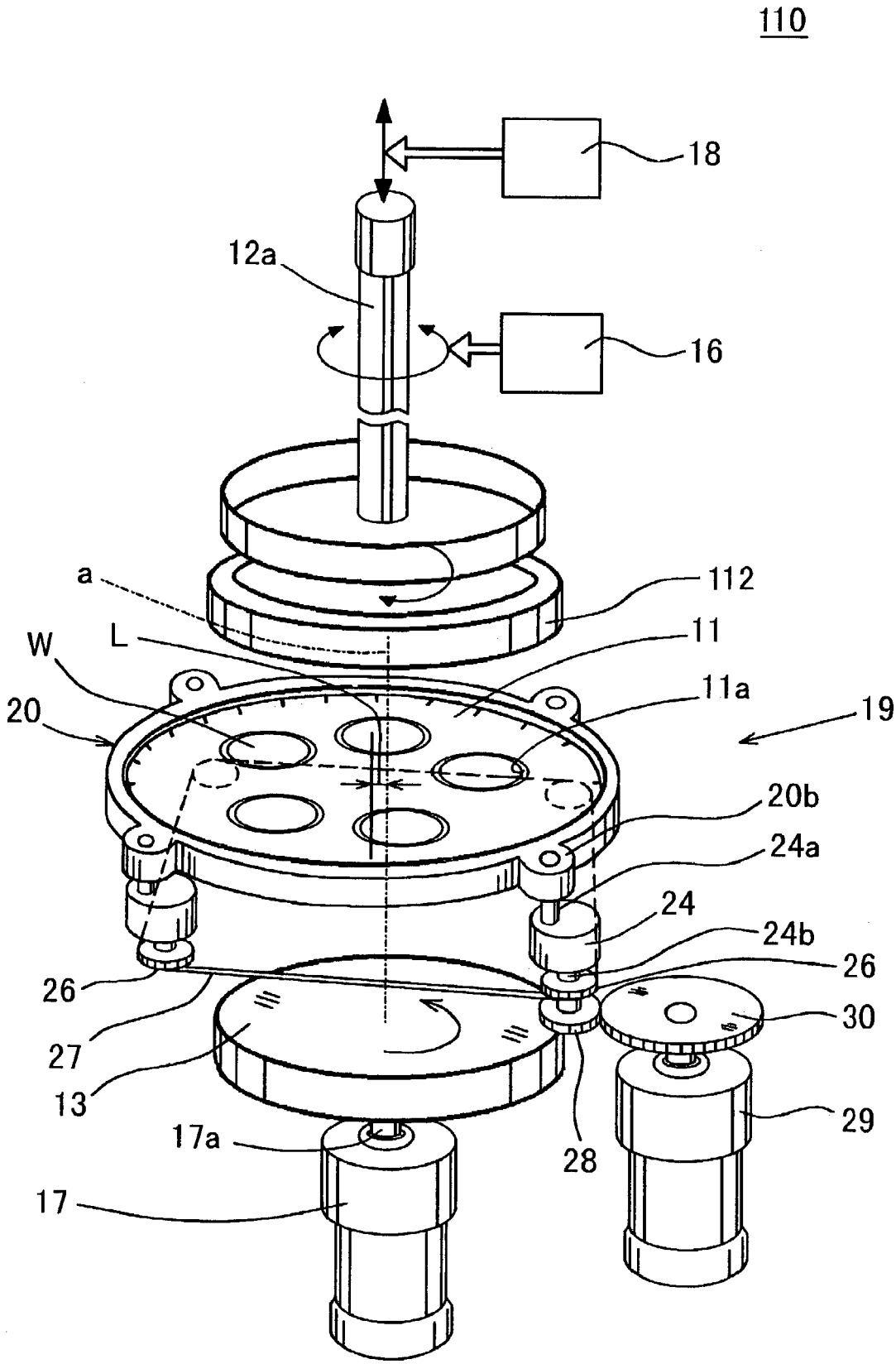
FIG. 8 is a perspective view illustrating a double-sided polisher according to a fifth embodiment of the present invention.
Figure 9:
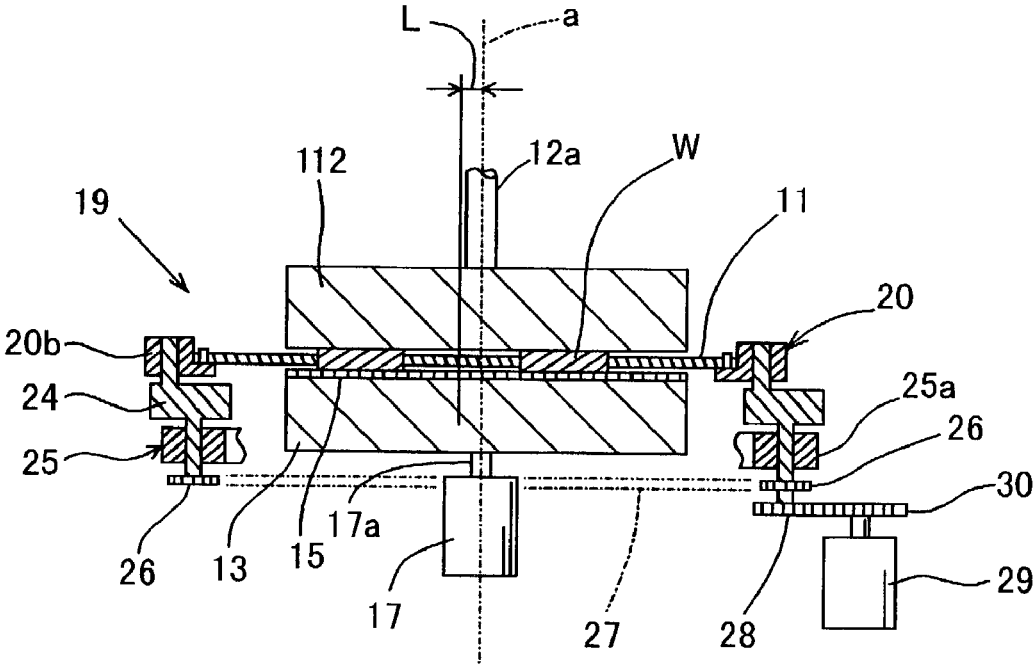
FIG. 9 is a longitudinal sectional view illustrating a double-sided polishing process in a method of manufacturing a semiconductor wafer according to the fifth embodiment of the present invention.
Figure 10:
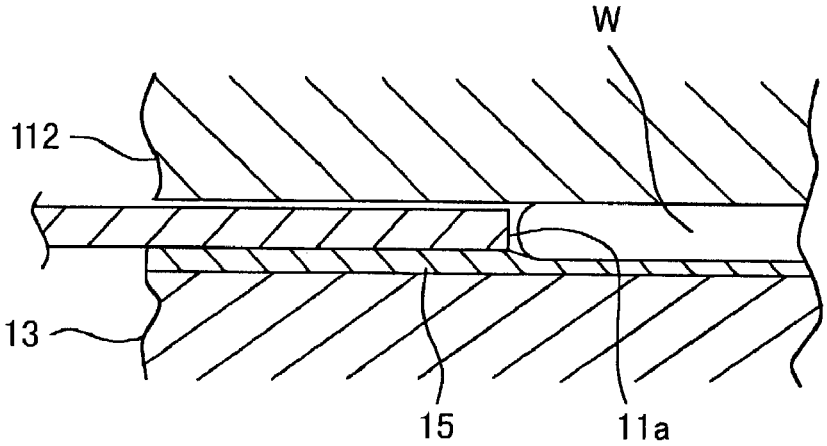
FIG. 10 is a sectional view illustrating a polishing process in the method of manufacturing the semiconductor wafer according to the fifth embodiment of the present invention.
Figure 11:
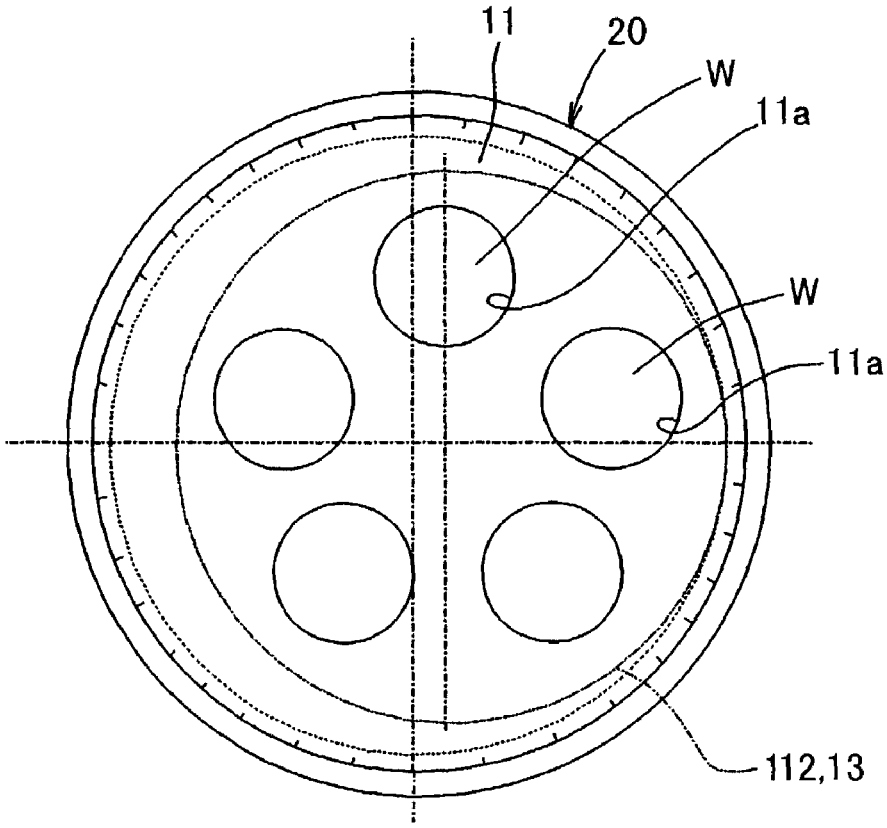
FIG. 11 is a plan view illustrating a general configuration of the double-sided polisher according to the fifth embodiment of the present invention.
Figure 12:
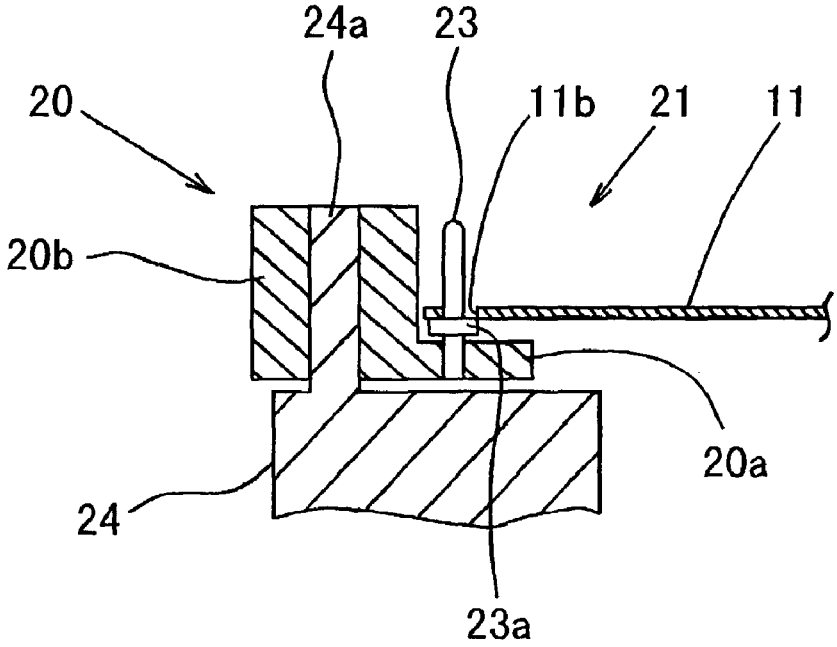
FIG. 12 is an enlarged sectional view illustrating a main part of a driving force transmission system for transmitting a driving force to a carrier plate according to the fifth embodiment of the present invention.

In FIG. 8 and FIG. 9, reference numeral 110 generally designates a double-sided polisher to which is applied a method of polishing a semiconductor wafer according to the fifth embodiment of the present invention. This double-sided polisher 110 has almost the same configuration as of the double-sided polisher in the first embodiment, and comprises: a carrier plate 11 having five wafer holding holes 11*a* formed therethrough; an abrasive roller (abrasive wheel) 112 disposed in an upper side for polishing the front surface of the silicon wafer W into a mirror-finished surfaces by moving relatively to the silicon wafer W held in each of the wafer holding holes 11*a* so as to be free to rotate; and a polishing surface plate 13 disposed in an under side for polishing the back surfaces of the wafers W only by a small amount into a satin-finished surfaces by using a polishing cloth.

The abrasive roller 112 is a bonded abrasive body for mirror-polishing the front surface of the wafer disposed to face upward, and is made of abrasive grains, which have been formed into a disc-like shape by using bond. In specific, this abrasive roller 112 comprises a roller body which is made of epoxy resin formed into a main component of the roller having a diameter of 300 mm and a thickness of 10 mm, and also includes the fine abrasive grains (silica particles) having a grain size of 3 μm fixedly attached over an entire area of the exposed surface of the roller body including its abrasive surface. A mixed amount of the abrasive grains to the entire resin has been set to be 15 with respect to the synthetic resin 100 as indicated by the volume ratio. To fixedly attach those abrasive grains to the abrasive roller 112, such a method has been employed, in which a liquid epoxy resin of room temperature setting type is mixed with the abrasive grains, which is then cast in a casting die.

On the other hand, a soft non-woven fabric pad 15 made of non-woven fabric impregnated with urethane resin and then set therewith is extended over the upper surface of the polishing surface plate 13. The non-woven fabric pad 15 (MH-15 manufactured by Rodale Inc.) has a hardness of 80° (as measured by the Asker hardness meter) and a thickness of 1270 μm.

As shown in FIG. 8 and FIG. 9, the abrasive roller 112 is driven to rotate within a horizontal plane by an upper rotary motor 16 via a rotary shaft 12*a* extending upward. In addition, this abrasive roller 112 is moved up or down in the vertical direction by a lifting gear 18. The pushing pressures of the abrasive roller 112 and the polishing surface plate 13 to be applied onto the front and the back surfaces of the silicon wafer W may be generated by pressurizing means incorporated in the abrasive roller 112 and the polishing surface plate 13, though not shown.

The polishing surface plate 13 is driven to rotate within a horizontal plane by a lower rotary motor 17 via its output shaft 17*a*. The carrier plate 11 is driven by a carrier circular motion mechanism 19 so as to make a circular motion within a horizontal plane but not to rotate on its own axis.

As shown in FIG. 8, FIG. 9 and FIGS. 11 through 13, this carrier circular motion mechanism 19 is almost same as that in the first embodiment described above and therefore a detailed description therefor should be omitted.

Accordingly, in this apparatus, when the output shaft of the circular motion motor 29 is rotated, the turning force generated thereby is transmitted to a timing chain 27 via gears 30, 28 and a sprocket 26. Then the timing chain 27 is driven to run along a course supported by four sprockets 26, and finally all the four eccentric arms 24 are driven by respective sprockets 26 to synchronously rotate around respective rotary shafts 24*b* within the horizontal plane. By way of this, a carrier holder 20 operatively coupled with an assembly consisting of respective eccentric shafts 24*b* and thus the carrier plate 11 held by the holder 20 can make the circular motion associated with no rotation on their own axes, within the horizontal plane parallel with the plate 11. That is, the carrier plate 11 is revolved around an axis line "a" of the abrasive roller 112 and the polishing surface plate 13 while being held in an eccentric position therefrom by a distance "L". Owing to this circular motion of the carrier plate 11 associated with no rotation on its own axis, every point on the carrier plate 11 may follow the orbit tracing the same sized small circle.

Figure 13:
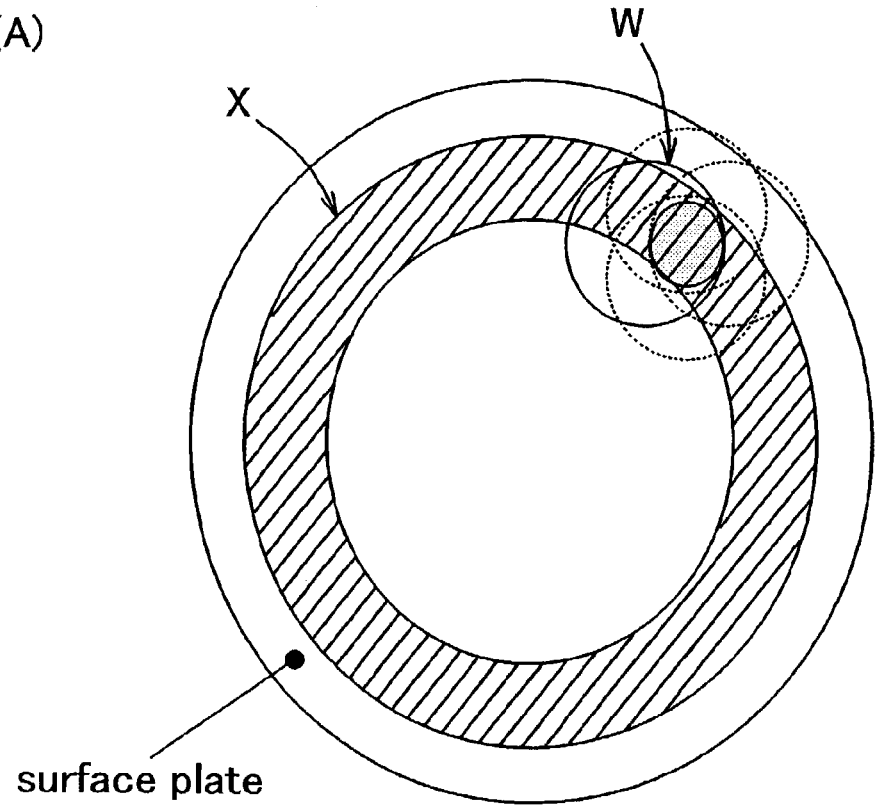
FIG. 13 is a plan view illustrating a location of a polishing agent supply hole according to the fifth embodiment of the present invention.
Figure 13:
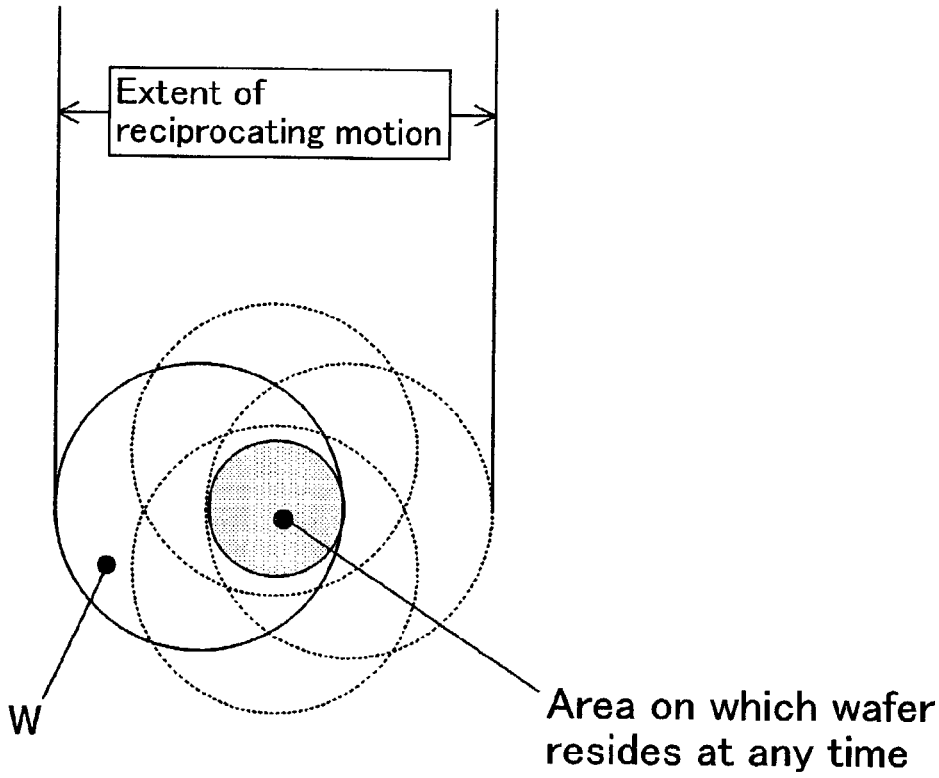

Further, FIG. 13 shows a location of a slurry supply hole in this apparatus. For example, a plurality of slurry supply holes formed in the abrasive roller 112 is located within an annular region "X" having a predetermined width on which the silicon wafer W resides at any time. This configuration allows the slurry to be supplied any time to the front surface of the silicon wafer W, which is to be mirror-finished, even when the silicon wafer W is moved in a reciprocating manner. As a polishing agent is used an alkaline liquid composed mainly of aminoethylethanolamine, which has its pH value adjusted to 10.5. As a result, the thin film formed by the slurry can be always maintained over the back surface of the silicon wafer W during polishing.

A method of polishing a silicon wafer W by using a double-sided polisher 110 will now be described.

At first, silicon wafers W are inserted in respective wafer holding holes 11*a* of the carrier plate 11. At that time, each of the silicon wafers is placed with its front surface facing up. Secondary, in this state, the abrasive roller 112 is pressed against the front surfaces of respective wafers at the pressure level of 200 g/cm$^2$, while the soft non-woven fabric pad 15 is pressed against the back surfaces of respective wafers at the pressure level of 200 g/cm$^2$.

Then, with those two abrasive members 112, 15 being pressed against the front and the back surfaces of the wafers W, the timing chain 27 is driven to run along its course by the circular motion motor 29, while supplying the slurry from the abrasive roller 112 side. This causes all of the eccentric arms 24 to rotate synchronously within the horizontal plane, so that the carrier holder 20 and thus the carrier plate 11 make a circular motion associated with no rotation on its own axis at a speed of 15 rpm. As a result, respective silicon wafers W are polished in their both of the front and the back surfaces while being rotated in their corresponding wafer holding holes 11*a* within the horizontal plane.

In this apparatus, both of the front and the back surfaces of the wafer are polished by driving the carrier plate 11 to make a circular motion associated with no rotation on its own axis during polishing of the wafer. Since such a special motion of the carrier plate 11 has been employed to polish the silicon wafer W in both surfaces thereof, almost entire area in both of the front and the back surfaces of the wafer can be polished in a uniform manner.

Besides, since this apparatus has employed the abrasive roller 112 (for the front surface) and the polishing surface plate 13 with the polishing cloth extended thereon (for the back surface) as a pair of abrasive members for polishing the front and the back surfaces of the wafer, therefore the apparatus can polish, for example, selectively the front surface of the wafer thus to differentiate the quantities to be polished off from the front and the back surfaces of the wafer. Thus, such a semiconductor wafer having different glossiness between the front and the back surfaces thereof can be obtained.

It is to be noted that the double-sided polisher 110 according to this embodiment enables the double-sided polishing of each silicon wafer W simply by rotating the abrasive roller 112 at a speed of, for example, 25 rpm by the upper rotary motor 16, while rotating the polishing surface plate 13 at a speed of, for example, 10 rpm by the lower rotary motor 17, yet without driving the carrier plate 11 to make any circular motion.

In this case, since respective silicon wafers W have been inserted and held in the wafer holding holes 11*a* so as to be free to rotate therein, therefore during polishing, respective wafers W follow and thus rotate (on their own axes) in the same direction as of the rotation of either one of the surface plates having a higher rotating speed. As discussed above, allowing the silicon wafers W to rotate on their own axes can eliminate such an effect on the polishing by the abrasive roller 112 and the polishing surface plate 13 that the circumferential speed is getting higher as closing to the outer periphery of the wafer. This leads to the uniform polishing to be provided over an entire area of each one of the front and the back surfaces of the wafer respectively.

In this way, also by carrying out the double-sided polishing with the rotating speed of the abrasive roller 112 being differentiated from that of the polishing surface plate 13, such a silicon wafer having the mirror-finished front surface and the satin-finished back surface is still obtainable by using the double-sided polisher with no sun gear. Further, the abrasive 112 and the polishing surface plate 13 may be rotated at the same rotating speed thus to produce such a silicon wafer W having its front surface formed into the mirror-finished surface and its back surface formed into the satin-finished surface.

Alternatively, the abrasive roller 112 and the polishing surface plate 13 may be rotated while allowing the carrier plate 11 to make a circular motion so as to carry out the double-sided polishing of the silicon wafer W. In this case, preferably the rotating speeds of the abrasive roller 112 and the polishing surface plates 12 and 13 are rather slowed down within a range in which uneven polishing would not be induced in both of the front and the back surfaces of the wafer. With this arrangement, both of the front and the back surfaces of the silicon wafer W can be polished uniformly over the entire area of respective surfaces. It is to be considered preferable that rotating the abrasive roller 112 and the polishing surface plate 13 can provide new contact faces of the surface plates with respect to the silicon wafer W at any time, so that the slurry can be supplied to the entire surfaces of the silicon wafer W uniformly.

Actually, the glossiness of the mirror-finished front surface and the satin-finished back surface of the silicon wafer W, which are created by the double-sided polishing of the silicon wafer W using the double-sided polisher 10 of this embodiment based on its conditions for the double-sided polishing, were measured respectively. The result indicated that the glossiness of the mirror-finished front surface of the wafer was equal to or greater than 330% as measured by the measuring instrument from Nippon Denshoku Inc. In contrast to this, the glossiness of the back surface of the wafer fell in a range of 200-300%.

Figure 14:
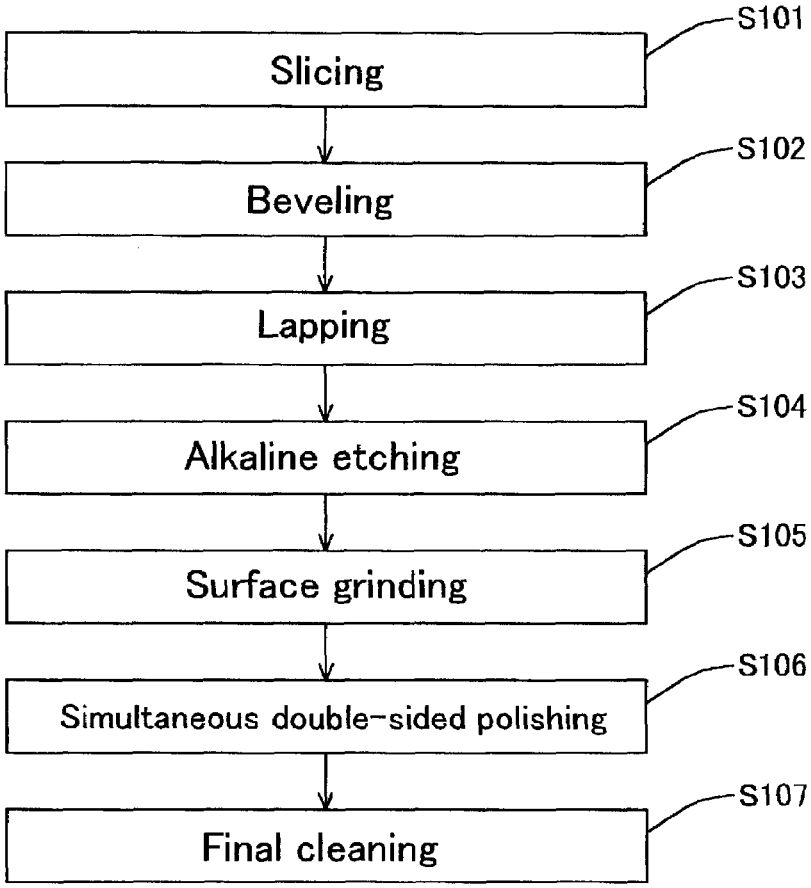
FIG. 14 is a flow chart illustrating a method of manufacturing a semiconductor wafer according to a sixth embodiment of the present invention.
Figure 15:
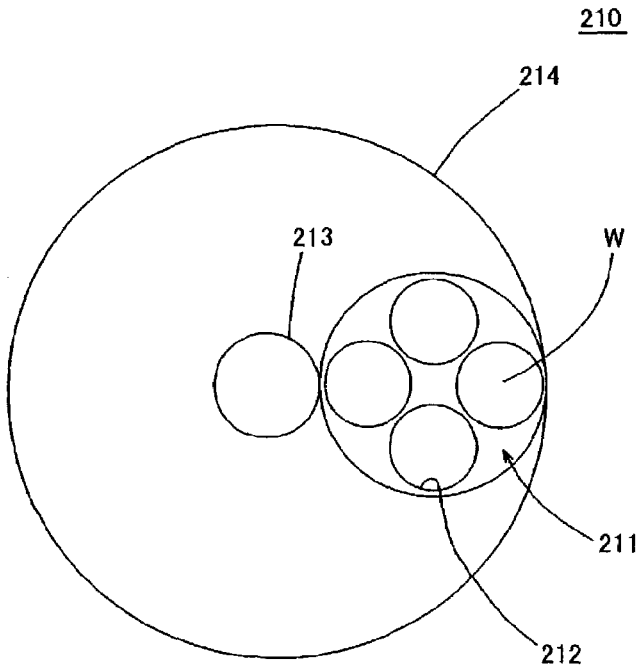
FIG. 15 is a plan view illustrating schematically a double-sided polisher used in the method of manufacturing the semiconductor wafer according to the sixth embodiment of the present invention.
Figure 16:
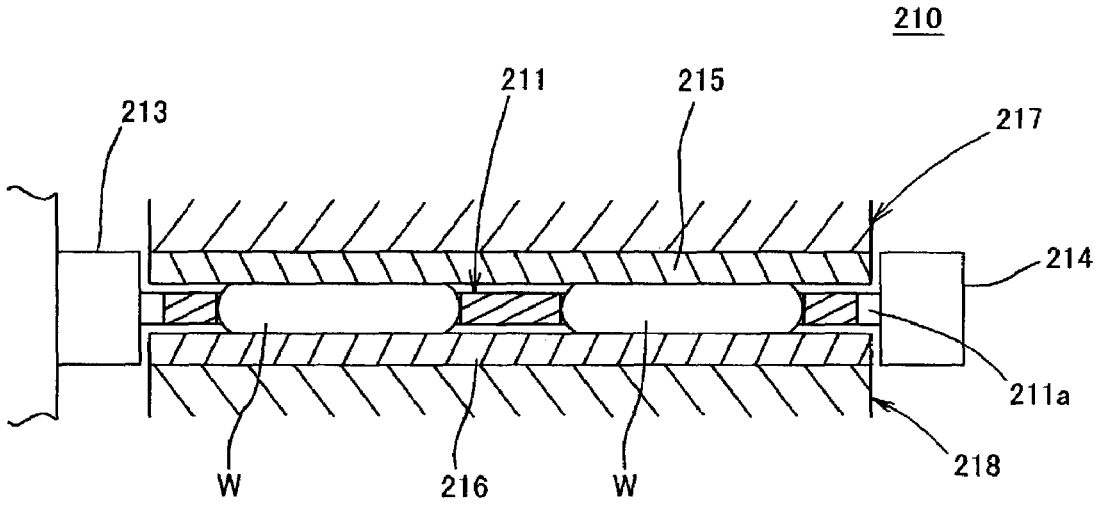
FIG. 16 is an enlarged sectional view illustrating a main part of the double-sided polisher according to the sixth embodiment of the present invention.

A sixth embodiment of the present invention will now be described with reference to the attached drawings. FIG. 14 is a flow chart illustrating a method of manufacturing a semiconductor wafer according to this embodiment. FIG. 15 is a plan view of a double-sided polisher used in the method of manufacturing a semiconductor wafer according to this embodiment. FIG. 16 is an enlarged sectional view illustrating a main part of this double-sided polisher.

As shown in FIG. 14, in this embodiment, a semiconductor wafer is manufactured through a series of processing steps of slicing, beveling, lapping, alkaline etching, surface grinding, double-sided polishing and final cleaning. Respective steps will now be described in detail.

A silicon ingot pulled up in the Czochralski method is sliced into 8-inch silicon wafers, each having a thickness of about 860 μm, in the slicing step (S101).

Then, each of those silicon wafers is subjected to the beveling process (S102). In specific, the outer periphery of the wafer is roughly beveled to be formed into a specified shape by using a grinding wheel of #600 for metal beveling. By this process, the outer periphery of the wafer is shaped into a specified round shape (for example, a beveled shape of MOS type).

In next step, after having been subjected to the beveling processing, the silicon wafer is lapped in the lapping step (S103). In this lapping step, the silicon wafer is placed between the lapping surface plates held in parallel with each other, and a lapping liquid, a mixture consisting of alumina abrasive grains, a dispersant and the water, is introduced between the lapping surface plates and the silicon wafer. Then, the silicon wafer is subjected to a rotation/grinding processing under a certain pressure so as for the both of the front and the back surfaces thereof to be lapped mechanically. A quantity to be removed in the lapping step is within a range of 40-80 μm as a total for the front and the back surfaces of the wafer.

Following to the lapping process, the silicon wafer is subject to the alkaline etching (S103).

NaOH solution in high concentration is used as the alkaline etching liquid. The etching temperature of 90° C. and etching period of 3 minutes are used. At that time, the quantity to be removed from the wafer by etching is about 20 μm totally for both the front and the back surfaces. As specified above, since the alkaline etching has been employed instead of the acid etching, therefore such a waviness having a cycle distance of about 10 mm and a height of some tens to some hundreds nm would not appear.

Next, the surface grinding is applied to this etched wafer (S105). In specific, a surface grinder equipped with a resinoid grinding wheel of #2000 is used to apply the surface grinding to the wafer. The quantity to be ground off in this stage is about 10 μm. It is to be noted that the damage due to the processing after the surface grinding is in a range of 1-3 μm.

After the surface grinding, the double-sided polishing is applied to the silicon wafer, in which the front surface thereof is mirror-finished while at the same time the back surface thereof is lightly polished so as to partly remove the concavity and convexity having formed thereon (S106). A double-sided polisher shown in FIG. 15 and FIG. 16 has been specifically employed as this double-sided polisher. This double-sided polisher will be described below in detail.

In FIG. 15 and FIG. 16, reference numeral 210 generally designates the double-sided polisher. In the double-sided polisher 210, the silicon wafers W are inserted and thus held in a plurality of wafer holding holes 212 formed in a carrier plate 211 respectively, and both of the front and the back surfaces of respective silicon wafers W are polished all at once while supplying the slurry containing abrasive grains onto the silicon wafers W from above.

In specific, between a sun gear 213 and an internal gear 214, which are provided so as to be free to rotate, a carrier plate 211 having an external gear 211*a* on an outer periphery thereof is disposed so as to be free to rotate on its own axis and also to revolve around the sun gear 213, and an upper surface plate 217 and a lower surface plate 218 having a polishing cloth 215 and a polishing cloth 216 respectively extended on them are pressed against and thus slidably contacted with the front and the back surfaces (top and bottom surfaces) of the silicon wafers W, so that both surfaces of those silicon wafers W may be polished all at the same time.

As for the polishing cloth 215 for polishing the front surface (mirror-finished surface) of the silicon wafer W, a polishing cloth "suba 800" manufactured by Rodale and Nitta Co., Ltd. has been employed, which has a higher ability of retaining the slurry and thus brings a higher polishing rate (0.5 μm/min) on the front surface of the wafer. On the other hand, as to the polishing cloth for the back surface (semi mirror-finished surface) of the wafer, a polishing cloth "UR-100" manufactured by Rodale and Nitta Co., Ltd. has been employed, which has a lower ability of retaining the slurry and thus brings a lower polishing rate (0.07 μm/min) on the back surface of the wafer. As specified herein, since the polishing cloths made of different materials, which can create a difference in the slurry retaining ability leading to a difference in the polishing rate between the cloths, have been employed as the polishing cloth 215 for the front surface and the polishing cloth 216 for the back surface of the wafer respectively, therefore, during double-sided polishing of the wafer, the front surface of the wafer can be mirror-finished, while on the other hand the back surface of the wafer is hard to be polished into a mirror-finished surface.

The quantity to be polished off from the front surface of the wafer by this double-sided polishing process is around 7 μm. On the other hand, that from the back surface of the wafer is no greater than 1.5 μm.

As discussed above, such a low-damage polishing has been applied in advance to the front surface of the wafer which will be mirror-polished. Therefore, in this double-sided polishing process, the quantity to be polished off from the front surface of the wafer could be reduced to 7 μm. As a result, the front surface of the wafer, after having finished with the double-sided polishing, indicates to be a wafer of higher degree of flatness with no greater than 0.3 μm as measured in GBIR. In addition, with this reduced quantity to be polished off, the required polishing time is also shortened.

Further, since the back surface of the wafer is light-polished during this double-sided polishing, the concavity and convexity formed on the back surface of the wafer during the alkaline etching step can be partially remove thereby reducing the magnitude of the concavity and convexity.

In addition, since in this embodiment, the quantity to be polished off from the back surface during the double-sided polishing is set to be in a range of 0.5 μm-1.5 μm, the intensity of the back surface of the wafer can be controlled to be a certain intensity, based on which the front or the back surface of the wafer can be identified by using the wafer back surface detecting sensor. This enables the front surface and the back surface of the wafer to be identified automatically.

After this step, the silicon wafer is subjected to a final cleaning process for finishing the wafer (S107). In specific, some kinds of RCA cleaning is applied.

Further, although the sixth embodiment has employed the double-sided polisher with sun gear, the polisher is not limited to this, but may use, for example, the double-sided polisher with no sun gear according to the first embodiment described above (FIG. 1).

What is claimed is:

1. A method of manufacturing a semiconductor wafer comprising holding a semiconductor wafer in a wafer holding hole formed in a carrier plate, and simultaneously polishing a front and a back surface of said semiconductor wafer by driving said carrier plate to make a circular motion associated with no rotation on its own axis within a plane parallel with a surface of said carrier plate between an upper surface plate and a lower surface plate having polishing cloths extended thereon respectively, while supplying a slurry containing abrasive grains to said semiconductor wafer, said method being characterized in that one polishing cloth different from the other polishing cloth in a sink rate of the semiconductor wafer during polishing is used for one of said upper and said lower surface plates while using said the other polishing cloth for the other of said surface plates so as to differentiate a glossiness between said front surface and said back surface of said semiconductor wafer.

2. A method of manufacturing a semiconductor wafer in accordance with claim 1, in which a density of said polishing cloth of said upper surface plate is different from that of said polishing cloth of said lower surface plate.

3. A method of manufacturing a semiconductor wafer in accordance with claim 1, in which a compressibility of said polishing cloth of said upper surface plate is different from that of said polishing cloth of said lower surface plate.

4. A method of manufacturing a semiconductor wafer in accordance with claim 1, in which an elastic modulus in compression of said polishing cloth of said upper surface plate is different from that of said polishing cloth of said lower surface plate.

5. A method of manufacturing a semiconductor wafer in accordance with claim 1, in which said slurry is supplied from a slurry supply hole located right above said wafer holding hole.

6. A method of manufacturing a semiconductor wafer in accordance with claim 1, in which either one of said front surface and said back surface of said semiconductor wafer is polished lightly to form a light-polished surface by using a polishing cloth having a lower sink rate of the semiconductor wafer.

7. A method of manufacturing a semiconductor wafer in accordance with claim 1, in which said semiconductor wafer is coated with an oxide film on either one of said surfaces thereof.

8. A method of manufacturing a semiconductor wafer in accordance with claim 1, in which a hardness of said polishing cloth of said upper surface plate is different from that of said polishing cloth of said lower surface plate.

9. A method of manufacturing a semiconductor wafer in accordance with claim 8, in which either one of said polishing cloth of said upper surface plate and said polishing cloth of said lower surface plate is made of expanded urethane foam pad and the other of said polishing cloths is made of non-woven fabric pad.

* * * * *